US006983862B2

(12) United States Patent
Nottingham et al.

(10) Patent No.: US 6,983,862 B2
(45) Date of Patent: Jan. 10, 2006

(54) CONTAINER AND LID ASSEMBLY

(75) Inventors: John R. Nottingham, Bratenahl, OH (US); John Spirk, Gates Mills, OH (US); Dale A. Panasewicz, Strongsville, OH (US); Nick E. Stanca, Westlake, OH (US); Robert Iredell, IV, Cleveland Heights, OH (US); Dennis M. Futo, Strongsville, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 475 days.

(21) Appl. No.: 10/126,481

(22) Filed: Apr. 18, 2002

(65) Prior Publication Data

US 2002/0195471 A1 Dec. 26, 2002

Related U.S. Application Data

(60) Provisional application No. 60/284,476, filed on Apr. 18, 2001, and provisional application No. 60/292,364, filed on May 21, 2001.

(51) Int. Cl.
*B67D 1/16* (2006.01)

(52) U.S. Cl. ..... 222/109; 222/567; 222/568; 222/571; 220/760; 220/771; 206/508

(58) Field of Classification Search ..... 222/109, 222/558, 567, 569, 570, 571, 568; 220/23.88, 220/288, 700, 760, 771; 206/499, 508; 366/110; 239/302

See application file for complete search history.

(56) References Cited

U.S. PATENT DOCUMENTS 1,599,967 A 9/1926 Johnson
1,611,443 A 12/1926 Hothersall (Continued)

FOREIGN PATENT DOCUMENTS

CA 800836 12/1968
EP 0 521 705 B1 6/1995

(Continued)

OTHER PUBLICATIONS

Internet Search: DoitBest.com entitled "paint & supplies", 2 pages, date unknown.
Internet Search: AircraftSpruce.com entitled "pouring pal clip on pour spout", 2 pages, date unknown.
Internet Search: CatalogCity.com entitled "Paint–Can Spouts", 1 page, date unknown.
Internet Search: American Trade Products, Inc. entitled "Paint Sundry Items", 3 pages, date unknown.
Internet Search: Paint n Pour entitled "Ideal for the D.I.Y. painter", 1 page, date unknown.

(Continued)

*Primary Examiner*—Joseph A. Kaufman
(74) *Attorney, Agent, or Firm*—Eryn Ace Fuhrer; Robert E. McDonald; Calfee, Halter & Griswold, LLP

(57) ABSTRACT

A plastic container and lid assembly for storing liquid coating materials including a container and a lid. The container has a body with a bottom wall, at least four sidewalls and a neck. The neck defines a wide mouth opening and including threads for receiving mating threads on the lid. The lid also has a plurality of lugs, preferably two lugs, extending radially from the lid and terminating at or before the lugs extend beyond the container sidewalls when the lid is in sealed engagement with the container. The body also has an integral handle for lifting the container and the container neck supports a bail-type handle also for lifting said container. The integral handle and bail-type handles do not extend beyond the container sidewall. The container and lid assembly having an effective packing footprint and an effective packing volume which substantially conforms to the effective packing footprint and the effective packing volume of a conventional metal paint can.

49 Claims, 20 Drawing Sheets

U.S. PATENT DOCUMENTS

| | | | | |
|---|---|---|---|---|
| D89,681 | S | | 4/1933 | Crimmel et al. |
| 2,120,487 | A | | 6/1938 | Connor |
| 2,194,486 | A | | 3/1940 | Straub |
| 2,324,338 | A | | 7/1943 | Tripp |
| D138,004 | S | | 5/1944 | Sharp |
| 2,520,549 | A | | 8/1950 | Jacobsen |
| 2,659,519 | A | | 11/1953 | Allen |
| 2,660,333 | A | | 11/1953 | Paxton |
| 2,707,574 | A | | 5/1955 | Klebenow |
| 2,743,844 | A | | 5/1956 | Livingstone |
| 2,763,402 | A | | 9/1956 | Livingstone |
| 2,817,465 | A | | 12/1957 | Gray |
| D182,779 | S | | 5/1958 | Tupper |
| 2,840,124 | A | | 6/1958 | Greene |
| 2,851,196 | A | | 9/1958 | Livingstone |
| 3,000,527 | A | | 9/1961 | Jennings et al. |
| D192,886 | S | | 5/1962 | Kaplan |
| D193,446 | S | | 8/1962 | Houghton |
| D198,287 | S | | 5/1964 | Hulterstrum |
| D201,157 | S | | 5/1965 | Harlow |
| D204,171 | S | | 3/1966 | Szajna |
| 3,275,187 | A | * | 9/1966 | Lamoureaux ..... 220/700 |
| D206,407 | S | | 12/1966 | Sharp |
| 3,310,088 | A | | 3/1967 | Hildebrandt et al. |
| D207,466 | S | | 4/1967 | Phillips |
| 3,313,438 | A | | 4/1967 | Piker |
| D209,018 | S | | 10/1967 | Holtz |
| 3,358,877 | A | | 12/1967 | Eckhoff |
| 3,366,290 | A | | 1/1968 | Mojonnier et al. |
| 3,387,749 | A | | 6/1968 | Godshalk et al. |
| 3,388,841 | A | | 6/1968 | McHardy |
| D211,928 | S | | 8/1968 | Burnett |
| 3,434,635 | A | | 3/1969 | Mason, Jr. |
| D214,360 | S | | 6/1969 | Huber |
| 3,473,685 | A | | 10/1969 | Harlan |
| D217,231 | S | | 4/1970 | Pashman |
| 3,526,110 | A | | 9/1970 | Foote |
| 3,533,503 | A | | 10/1970 | Wood et al. |
| 3,593,880 | A | | 7/1971 | Kulbacki |
| 3,595,431 | A | | 7/1971 | Bird |
| D221,515 | S | | 8/1971 | Betka |
| D221,518 | S | | 8/1971 | Weckman |
| 3,596,813 | A | | 8/1971 | Munn |
| 3,612,595 | A | | 10/1971 | Updegraff et al. |
| 3,620,410 | A | | 11/1971 | Griese, Jr. |
| 3,625,386 | A | | 12/1971 | Schaefer |
| 3,659,758 | A | | 5/1972 | Waterman |
| D224,200 | S | | 7/1972 | Kretz |
| 3,695,488 | A | | 10/1972 | Olsson |
| 3,727,792 | A | | 4/1973 | Levin |
| D226,901 | S | | 5/1973 | Galer |
| 3,730,382 | A | | 5/1973 | Heisler |
| 3,744,671 | A | | 7/1973 | Saunders, Jr. |
| 3,756,451 | A | | 9/1973 | Popeil |
| 3,807,679 | A | | 4/1974 | Burke et al. |
| 3,866,791 | A | | 2/1975 | Roper et al. |
| 3,889,732 | A | | 6/1975 | Wilkins |
| 3,899,107 | A | | 8/1975 | Gaal |
| 3,913,785 | A | | 10/1975 | Pattershall |
| 3,927,797 | A | | 12/1975 | Flider |
| 3,938,686 | A | | 2/1976 | Milligan et al. |
| 3,945,527 | A | | 3/1976 | Pylant |
| 4,014,465 | A | | 3/1977 | Ritter |
| 4,022,352 | A | | 5/1977 | Pehr |
| D244,990 | S | | 7/1977 | Anderson |
| D246,227 | S | | 11/1977 | Douglas |
| 4,061,242 | A | | 12/1977 | Donlon |
| 4,077,613 | A | | 3/1978 | Wilson ..... 366/213 |
| 4,078,700 | A | | 3/1978 | Hidding |
| D248,216 | S | | 6/1978 | Allen et al. |
| 4,128,189 | A | | 12/1978 | Baxter |
| 4,129,236 | A | | 12/1978 | Wrycraft et al. |
| D250,806 | S | | 1/1979 | Gutkowski |
| D251,358 | S | | 3/1979 | Gutkowski |
| 4,150,763 | A | | 4/1979 | Simpson |
| 4,171,063 | A | | 10/1979 | Cloutier |
| 4,193,699 | A | | 3/1980 | Haygeman et al. |
| 4,203,537 | A | | 5/1980 | McAlister |
| 4,225,064 | A | | 9/1980 | Westcott |
| 4,228,916 | A | | 10/1980 | Weingardt |
| 4,240,568 | A | | 12/1980 | Pool |
| 4,245,753 | A | | 1/1981 | Ellis |
| 4,245,754 | A | | 1/1981 | Ellis |
| D258,563 | S | | 3/1981 | Romagnoli |
| 4,281,770 | A | | 8/1981 | Rainville |
| D261,362 | S | | 10/1981 | Epperson |
| 4,298,145 | A | | 11/1981 | Iida |
| 4,312,459 | A | | 1/1982 | Leach |
| D265,176 | S | | 6/1982 | Bock |
| D265,797 | S | | 8/1982 | Platte |
| 4,380,304 | A | | 4/1983 | Anderson |
| 4,386,701 | A | | 6/1983 | Galer |
| 4,387,828 | A | | 6/1983 | Yates, Jr. |
| 4,387,922 | A | | 6/1983 | Geisinger |
| D269,948 | S | | 8/1983 | Janssen |
| 4,399,926 | A | | 8/1983 | Eidels-Dubovoy |
| 4,412,633 | A | | 11/1983 | Guerrazzi et al. |
| 4,431,326 | A | | 2/1984 | Braithwaite et al. |
| 4,453,647 | A | | 6/1984 | Neat |
| 4,457,458 | A | | 7/1984 | Heinol |
| 4,458,819 | A | | 7/1984 | Geiger |
| 4,463,867 | A | | 8/1984 | Nagel |
| 4,474,303 | A | | 10/1984 | Maccise |
| D276,890 | S | | 12/1984 | Hancher |
| D277,363 | S | | 1/1985 | Drummond, Jr. et al. |
| 4,491,234 | A | | 1/1985 | Wilcock |
| 4,494,674 | A | | 1/1985 | Roof |
| 4,520,936 | A | | 6/1985 | Lyons |
| D279,763 | S | | 7/1985 | Hestehave et al. |
| 4,530,442 | A | | 7/1985 | Vogel |
| 4,541,529 | A | | 9/1985 | Hestehave et al. |
| 4,548,332 | A | | 10/1985 | Neat |
| 4,549,977 | A | | 10/1985 | Joshi et al. |
| 4,550,862 | A | | 11/1985 | Barker et al. |
| D281,579 | S | | 12/1985 | Drummond, Jr. et al. |
| 4,575,074 | A | | 3/1986 | Damratoski |
| 4,583,666 | A | | 4/1986 | Buck |
| 4,616,759 | A | | 10/1986 | Mahler |
| 4,619,373 | A | | 10/1986 | Galer |
| 4,640,855 | A | | 2/1987 | St. Clair |
| D289,261 | S | | 4/1987 | Shadwell |
| D289,377 | S | | 4/1987 | Ashby et al. |
| 4,655,363 | A | | 4/1987 | Neat |
| 4,664,295 | A | | 5/1987 | Iida |
| 4,666,065 | A | | 5/1987 | Ohren |
| 4,669,617 | A | | 6/1987 | Boeckmann et al. |
| 4,671,421 | A | | 6/1987 | Reiber et al. |
| 4,696,416 | A | | 9/1987 | Muckenfuhs et al. |
| 4,702,395 | A | | 10/1987 | Nitsch |
| 4,706,829 | A | | 11/1987 | Li |
| 4,715,504 | A | | 12/1987 | Chang et al. |
| 4,717,034 | A | | 1/1988 | Mumford |
| 4,735,313 | A | | 4/1988 | Schoenberg |
| 4,736,874 | A | | 4/1988 | Durant |
| D296,421 | S | | 6/1988 | Rayner |
| D296,422 | S | | 6/1988 | Rayner |
| D296,873 | S | | 7/1988 | Dent et al. |
| D296,978 | S | | 8/1988 | Smith |
| D296,987 | S | | 8/1988 | Rayner |
| 4,771,501 | A | | 9/1988 | Leiter |
| 4,773,560 | A | | 9/1988 | Kittscher |
| 4,804,119 | A | | 2/1989 | Goodall |
| 4,805,793 | A | | 2/1989 | Brandt et al. |
| 4,830,234 | A | | 5/1989 | Odet |
| 4,860,927 | A | | 8/1989 | Grinde |
| 4,865,233 | A | | 9/1989 | Kain |
| D304,014 | S | | 10/1989 | O'Connell |
| D305,407 | S | | 1/1990 | Gonda |
| 4,890,768 | A | | 1/1990 | Robinson |
| 4,890,770 | A | | 1/1990 | Haga et al. |

4,892,126 A 1/1990 Bucheler et al.
4,893,723 A 1/1990 Seabolt
4,893,724 A 1/1990 Schiemann
4,893,732 A 1/1990 Jennings
D305,980 S 2/1990 Binder et al.
4,898,304 A 2/1990 Bacon, Jr.
4,899,885 A 2/1990 Van Koert
4,911,319 A 3/1990 DeJean
4,917,268 A 4/1990 Campbell et al.
D308,148 S 5/1990 Meyer
4,926,390 A 5/1990 Murzsa
4,927,046 A 5/1990 Armstrong
4,928,860 A 5/1990 Knight
D308,336 S 6/1990 Delbanco
4,941,815 A 7/1990 Julian
4,949,884 A 8/1990 Dahl
D311,681 S 10/1990 Aggarwal
D312,157 S 11/1990 Sjolander
4,969,617 A 11/1990 Desjardins
4,974,749 A 12/1990 Mon
D313,350 S 1/1991 Beaver
D313,461 S 1/1991 Hart et al.
4,981,239 A 1/1991 Cappel et al.
4,982,858 A 1/1991 von Holdt
4,984,714 A 1/1991 Sledge
4,993,605 A 2/1991 Del'Re
D315,298 S 3/1991 Marucci
D315,503 S 3/1991 Hart et al.
5,020,692 A 6/1991 Darr
D318,228 S 7/1991 Schlesselman
5,027,973 A 7/1991 Drogos
D320,345 S 10/1991 Hamly et al.
D320,741 S 10/1991 Willis et al.
D321,132 S 10/1991 Wiseman et al.
5,054,661 A 10/1991 Hollje
5,058,772 A 10/1991 Moore et al.
D321,624 S 11/1991 Fiore et al.
5,064,101 A 11/1991 Richter et al.
5,071,037 A 12/1991 Moore et al.
D323,115 S 1/1992 Kelsey
5,092,474 A 3/1992 Leigner
5,092,478 A 3/1992 La Pierre
5,105,858 A 4/1992 Levinson
5,108,009 A 4/1992 Davidson et al.
5,114,659 A 5/1992 Krall
D327,648 S 7/1992 Cane
5,131,566 A 7/1992 Bavegems
D329,597 S 9/1992 Gallagher et al.
5,160,067 A 11/1992 Luber
D332,747 S 1/1993 Darr et al.
5,181,630 A 1/1993 McNally
5,188,249 A 2/1993 Cargile
5,207,356 A 5/1993 Krall
D336,434 S 6/1993 Binder
D338,407 S 8/1993 Lynd
5,234,130 A 8/1993 Benioff et al.
5,267,675 A 12/1993 Cane
5,269,438 A 12/1993 Kelsey
5,269,977 A 12/1993 Nakahashi et al.
D342,898 S 1/1994 Cane
5,299,710 A 4/1994 Welsch et al.
5,303,839 A 4/1994 Blumenschein
D347,173 S 5/1994 Bogstad et al.
5,316,169 A 5/1994 Gallagher ..... 220/355
5,322,662 A 6/1994 Benioff et al.
D349,651 S 8/1994 Saffer
5,346,106 A 9/1994 Ring
D351,792 S 10/1994 Morris, Sr.
5,358,148 A 10/1994 Hanifl et al.
D352,459 S 11/1994 Pollacco
D352,659 S 11/1994 Nilsson et al.
5,366,101 A 11/1994 Krall et al.
D353,541 S 12/1994 Rogler et al.
D354,225 S 1/1995 Norton et al.
5,377,858 A 1/1995 Morris, Sr.
5,383,558 A 1/1995 Wilkinson et al.
D355,366 S 2/1995 Bainton
5,390,805 A 2/1995 Bilani et al.
5,392,968 A 2/1995 Dark
5,401,200 A 3/1995 Ellis
5,409,128 A 4/1995 Mitchell
D358,333 S 5/1995 Stockwell et al.
5,431,306 A 7/1995 Reid
D360,830 S 8/1995 Hestehave et al.
5,445,195 A 8/1995 Kim
D362,180 S 9/1995 Haines
D362,625 S 9/1995 Braun
5,462,202 A 10/1995 Haffner et al.
5,492,240 A 2/1996 Vilutis
D367,612 S 3/1996 Shaw et al.
5,509,579 A 4/1996 Robbins, III
D370,153 S 5/1996 Chaney et al.
5,517,837 A 5/1996 Wang
D370,850 S 6/1996 Beaver
D371,485 S 7/1996 Hickey
D372,197 S 7/1996 Gough
D374,178 S 10/1996 Valls et al.
5,566,861 A 10/1996 Serano
5,566,862 A 10/1996 Haffner et al.
5,577,626 A 11/1996 Henkel et al.
D376,761 S 12/1996 Lathrop et al.
5,586,805 A 12/1996 Rinehart
5,597,090 A 1/1997 Leahy
5,603,787 A 2/1997 Reid
D378,494 S 3/1997 Miller
D379,302 S 5/1997 Rodman
5,626,258 A 5/1997 Maiorino
5,626,319 A 5/1997 Fusillo
D380,682 S 7/1997 Robinson
5,669,526 A 9/1997 Keyfauver
5,678,684 A 10/1997 Wright
5,699,925 A 12/1997 Petruzzi
D388,708 S 1/1998 Monaghan
D389,067 S 1/1998 Lown
5,704,502 A 1/1998 Greenfield
D392,188 S 3/1998 Darr et al.
5,743,425 A 4/1998 Ellis
D395,825 S 7/1998 Freitas
5,775,483 A 7/1998 Lown et al.
5,787,839 A 8/1998 Magnant et al.
5,788,371 A 8/1998 Neri et al. ..... 366/217
5,794,803 A 8/1998 Sprick
5,823,345 A 10/1998 Nask et al.
D401,154 S 11/1998 Robinson
D401,246 S 11/1998 Langeveld et al.
D401,704 S 11/1998 Clark
D402,562 S 12/1998 Anderson et al.
D403,243 S 12/1998 Takeuchi et al.
5,850,953 A 12/1998 Dallas, Jr.
D403,578 S 1/1999 Paul et al.
D403,821 S 1/1999 Kerridge
5,855,299 A 1/1999 Arnold et al.
5,855,304 A 1/1999 Dean et al.
5,868,283 A 2/1999 Wilson et al.
5,868,323 A 2/1999 Cantor
5,875,942 A 3/1999 Ohmi et al.
5,893,489 A 4/1999 Giarrante
5,896,993 A 4/1999 Nask et al.
5,908,136 A 6/1999 Mrak
5,924,593 A 7/1999 Rutledge, Jr. et al.
5,941,404 A 8/1999 Charrette
5,941,422 A 8/1999 Struble
5,941,427 A 8/1999 Speer
D415,027 S 10/1999 Blazar
5,964,383 A 10/1999 Cargile
5,975,346 A 11/1999 Imperato et al.
D417,621 S 12/1999 Hofmeister et al.
D417,849 S 12/1999 Beaver
6,029,858 A 2/2000 Srokose et al.
6,029,864 A * 2/2000 Nilsson et al. ..... 222/466
D422,920 S 4/2000 Tapp et al.
6,053,650 A 4/2000 Bennett et al.

| | | | | | |
|---|---|---|---|---|---|
| 6,059,153 | A | | 5/2000 | Olson et al. | |
| 6,068,161 | A | | 5/2000 | Soehnlen et al. | |
| D426,164 | S | | 6/2000 | Gans et al. | |
| D426,925 | S | | 6/2000 | Axhamre | |
| D427,912 | S | | 7/2000 | Johnson et al. | |
| 6,085,949 | A | | 7/2000 | Zimny et al. | |
| D428,817 | S | | 8/2000 | Olson et al. | |
| D429,646 | S | | 8/2000 | Goettner | |
| D430,021 | S | | 8/2000 | Goettner | |
| D430,033 | S | | 8/2000 | Beaver et al. | |
| 6,105,813 | A | | 8/2000 | Abbey | |
| 6,109,487 | A | | 8/2000 | Hashimoto | |
| 6,123,231 | A | | 9/2000 | Geisinger | |
| 6,179,158 | B1 | | 1/2001 | Koda | |
| 6,209,762 | B1 | | 4/2001 | Haffner et al. | |
| 6,213,338 | B1 | * | 4/2001 | Cogdill | 220/700 |
| 6,223,945 | B1 | | 5/2001 | Giblin et al. | |
| 6,227,393 | B1 | * | 5/2001 | Takeuchi et al. | 215/398 |
| 6,247,600 | B1 | | 6/2001 | Sullivan, Jr. | |
| D445,028 | S | | 7/2001 | Grubstein | |
| D445,687 | S | | 7/2001 | Gilbertson | |
| 6,253,951 | B1 | * | 7/2001 | Pruckler | 220/733 |
| D446,121 | S | | 8/2001 | Maddy | |
| 6,269,977 | B1 | | 8/2001 | Moore | |
| 6,293,692 | B1 | | 9/2001 | Bowsher et al. | |
| D448,671 | S | | 10/2001 | Gans et al. | |
| D448,675 | S | | 10/2001 | Thierjung | |
| D449,535 | S | | 10/2001 | Geisinger et al. | |
| D454,070 | S | | 3/2002 | Crawford et al. | |
| D456,258 | S | | 4/2002 | Chin | |
| D458,844 | S | | 6/2002 | Shea | |
| 6,412,661 | B1 | | 7/2002 | Hannah, Sr. | |
| D461,717 | S | | 8/2002 | Crawford et al. | |
| D462,012 | S | | 8/2002 | Manderfield, Jr. | |
| D471,110 | S | | 3/2003 | Booth et al. | |
| D471,458 | S | | 3/2003 | Booth et al. | |
| 6,530,500 | B2 | * | 3/2003 | Rowles et al. | 222/143 |
| 2001/0025865 | A1 | | 10/2001 | Bravo et al. | |
| 2003/0034350 | A1 | | 2/2003 | Renzello | |
| 2003/0102339 | A1 | | 6/2003 | Walsh et al. | 222/567 |
| 2003/0102340 | A1 | | 6/2003 | Walsh et al. | 222/572 |
| 2003/0188986 | A1 | | 10/2003 | Wylie | 206/509 |

FOREIGN PATENT DOCUMENTS

| | | | |
|---|---|---|---|
| EP | 0 978 456 | A1 | 2/2000 |
| EP | 1243443 | A1 | 9/2002 |
| GB | 2 345 897 | | 7/2000 |
| WO | WO 02/076765 | A1 | 10/2002 |

OTHER PUBLICATIONS

Modern Paint and Coatings, v28, n7, p(28), article entitled "Manufacture keeping pace with paint container market ", 4 pages, Feb. 1992.

Packaging Week, v8, n30, p6, article entitled "Dulux relaunches paint in a user friendly can", 1 page, Jan. 1993.

Modern Paint and Coatings, "The Plastic Paint Container: Has Its Time Finally Come?", pp. 177, 178, and 180, Oct. 1983.

Packaging Week, "Container Stands by its Design", p. 25, Nov. 7, 1990.

Packaging Week, "Bristling With New Ideas", p. 21, Nov. 7, 1990.

Packaging Week, "Developments in Paint Packaging", vol. 181, No. 4279, p. 153, Mar. 20, 1991.

Packaging Week, "Confident Approach by RPC", pp. 16 and 17, Jun. 19, 1991.

Article entitled: "Marktgerechtes Verpackungsdesign", pp. 688 and 689, Jun. 1991.

The Best in Specialist Packaging Design, Article entitled: "Lens Sensations", 4 pages, 1993.

Packaging Week, "Breathing new life into old favourites", pp. 20 and 21, Oct. 13, 1994.

Cambridge Scientific Abstracts, pp. 1 through 51, Oct. 3, 2003.

Packaging Week, "Reed Invests in PET Paint Cans", 1 page, Feb. 3, 1990.

Emballanges Magazine, "Avi annonce la couleur!", p. 17, Nov. 1990.

Kautexwerke, "Kautex Konnen in Kunststoff", 4 pages, date unknown.

Food Engineering, "Dripless pouring for flowable foods", 2 pages, Jan. 1977.

Packaging Week, "Reed Moves into PET with Paint Container", vol. 5, Issue 33, 1 page, Jan. 3, 10, 1990.

Packaging Review, "Another brush with success for Mardon", p. 24, Jul. 1985.

Packaging Week, "Crown claims first for paint packaging", p. 11, Sep. 27, 1989.

Packaging Week, "Field unveils 2–litre flat–top paint carton", vol. 11, Issue 2, 1 page, May 18, 1995.

Packaging Week, "Dulux relaunches paint in a user friendly can", p. 6, Jan. 20, 1993.

Packaging, "How plastic cans can take on paint", 1 page, Aug. 1983.

Packaging Review, "What Price Paint in PP Pails?", vol. 100, No. 5, 1 page, Mar. 1980.

Modern Paint and Coatings, "Manufacturers Keeping Pace with Paint Container Market", vol. 82, No. 2, 4 pages, Feb. 1992.

Financial Times (London), article entitled "Packaging—Crown; cleaning up in the UK paint market", 3 pages, Jan., 1990.

Canadian Packaging, article entitled "Cap–ital idea", 2 pages, Jun. 1993.

Packaging Digest, article entitled "Laundry products wear washoff labels", 3 pages, Jan. 1994.

The Ottowa Citizen, article entitled "by design", 2 pages, Aug. 19, 1995.

San Antonio Express—News (Texas), article entitled "Inventor gets wrenching lessons about business", 3 pages, Dec. 8, 1996.

Chicago Tribune, article entitled "Off The Wall; Brush Up On The Latest Tools For Paint Cleanup", 2 pages, Mar. 19, 1999.

Internet Search: CatalogCity.com entitled "PourIt Paint Lids", 2 pages, date unknown.

Article entitled "Polypropylene in Packaging", Packaging, 12 pages, Apr. 1993.

Article entitled "Dulux pick a winner"; Packaging, 2 pages, Apr. 1993.

Thomas Jaffe, Article entitled "A Draconian Solution", Forbes, vol. 129, Issue 8, p. 122, Apr. 12, 1982.

Rosemary Dobson, Article entitled "Plastics' Clear Lead", Marketing, vol. 14, Issue 8, p. 27, Aug. 25, 1983.

Mark Spaulding, article entitled "Tougher Fire Code Hits Plastic Bottles", Packaging, vol. 33, Iss. 4; p. 8, Mar. 1988.

Article entitled Paint Can Battle Under Way (Steel vs. Plastics), Ind. Finish., vol. 61, No. 2, pp. 49–50, Feb. 1985.

Article entitled Plastic Challenges Steel in One–Gallon Paint Can Market, Mod. Met., vol. 41, No. 6, pp. 48–52, Jul. 1985.

Cathy Bond, article entitled "Paints packed with punch", Marketing, p. 25, May 18, 1995.

Anne and Henry Emblem, article entitled "Packaging 2 Prototypes", RotoVision SA, 12 pages, Copyright RotoVision SA 2000.
Packaging News, DIY & Hardware, article entitled "Printed pails compete for attention", 1 page, Feb. 1990.
Canadian Packaging, Product News, article entitled "Containers", p. 35, Dec. 1994.
Packaging Week, article entitled "Confident Approach At RPC", 1 page, Jun. 19, 1991.
Packaging Digest, Sample Pak flyer, p. 88, date unknown.
The Family Handyman, 6 pages, Jul./Aug. 2000.
Packaging Digest, newsperspective, 7 pages, Aug. 2000.
Packaging Digest, article entitled "Herbicide meets output, safety Goals", 11 pages, Apr., 1997.
Packaging Digest, article entitled "Pesticide bottle slants toward precise dosing", 8 pages, Aug., 1997.
Packaging Digest, newsperspective, 8 pages, Apr. 2000.
PACKbase—RPC Containers, Oakham, article entitled "RPC Oakham's New Pouring System Is Beyond System Is Beyond The Pail", 2 pages, date unknown.
The Family Handyman, Handy Hints, 3 pages, date unknown.
Flyer entitled "the Spin–X Spout", 1 page, date unknown.
Dialog Search, article entitled Plastics make tough tasks easier, (1992 Alfred I. Du Pont–Columbia University Awards for innovative packaging ideas), 11 pages.
Dialog Search, Ben Miyares, article entitled "Clear plastic gallons challenge glass jugs", 2 pages, Apr., 1992.
Design, article entitled "Tampereproof Dulux Paint Containers", 5 pages, date unknown.

* cited by examiner

CONTAINER AND LID ASSEMBLY

PRIORITY CLAIM

This application claims the benefit of U.S. provisional patent application No. 60/284,476 filed on Apr. 18, 2001 and U.S. provisional patent application No. 60/292,364 filed on May 21, 2001, the entirety of which are hereby incorporated by reference.

FIELD OF THE INVENTION

The application relates generally to containers and more specifically to a plastic container used to hold paint and similar coating materials.

BACKGROUND OF THE INVENTION

The most common way to store paints or other coatings has been within circular metal cans utilizing removable metal lids. In use, the lid is removed using a prying tool, the paint is stirred and then poured from the can. Alternatively, a brush is dipped directly into the can and the paint upon the brush is applied to an object. Most metal cans, such as steel paint cans, are moved and carried using a bail made from a steel wire and mounted in bosses on opposite sides of the container.

Traditional metal paint cans have numerous drawbacks which are obvious to anyone who has ever undertaken a painting project. First, removal of the lid can be difficult because a prying tool is required. A lid removal tool is fairly efficient, but often a screwdriver is used instead making the task more difficult. Replacement of the lid is also difficult in that a hammer or mallet is required to completely reseat opposed mating grooves on the lid and container. Alternatively, individuals often step on the top of the can to press the lid into place. This practice may be hazardous if one loses their balance, and messy when paint remains in the container grooves as a result of the pouring process.

Over time, due to the moisture inherent within the paint, metal pails and lids have a tendency to rust or corrode. If rust pieces fall into the paint, they often render the paint useless. Metal paint cans are also susceptible to impact damage when they are dropped, or impacted from the side. Once the can is deformed, seating and reseating the lid can be difficult and it can be difficult to return the can to a desired shape.

Pouring paint from metal paint cans is yet another difficult task due to the can's configuration. Flowing paint is difficult to guide because no spout formation exists upon the can. Paint usually runs down the side of the can and fills the container grooves in the lid seat area. The result is a messy container which is difficult to open upon next use. Manufacture of paint cans has also been difficult. The formation and attachment of metal wire bail handles is a difficult task to perform.

What is desired is a new paint and coating storage container which has improved properties of convenience, durability and pourability. Such a container would have an easily removable and replaceable lid. The container would also be simple to handle. The new container would also be comparable in capacity and dimensions with conventional metal storage containers so shipping, storage and in-store mixing can be performed using existing methods and systems already in place.

SUMMARY OF THE INVENTION

The present application provides an improved plastic container and lid assembly for storing liquid coating materials. The assembly includes a container and a lid. The container has a body with a bottom wall, a sidewall and a neck. The sidewall may be a circular cross sectional configuration, or a rectangular configuration, in which case, at least four sidewalls are provided. Where four sidewalls are provided, the distance between one sidewall and an opposite sidewall is equal to the diameter of a conventional one gallon metal paint can or a conventional one quart metal paint can, depending on the size of the assembly. Moreover, the effective volume of the assembly is identical to that of a conventional paint can, such that the assembly of the present application may readily replace conventional paint cans.

The neck defines a wide mouth opening which includes threads for receiving mating threads on the lid. The threads are preferably a double helix to provide for specific alignment of the lid with respect to the container body. The double helix thread on the lid engages the neck threads such that sealing engagement of the double helix thread is provided on the neck threads after between one half and three quarters of one revolution.

The lid has two or four lugs extending radially from opposite sides of said lid. The lugs terminate at or before the lugs extend beyond the container sidewall(s) when the lid is in sealed engagement with the container. The body may also include an integral handle for lifting the container. A second handle may also be provided. The second handle may be a bail-type handle supported on the container neck also for lifting the container. The integral handle and bail-type handle do not extend beyond said container sidewall. Thus, the container and lid assembly have a footprint which substantially conforms to the footprint of a conventional metal paint can. In the preferred embodiment where the four sidewalls are joined and define four corners, the lugs are aligned over the corners when the lid is in sealed engagement with the container.

The integral handle included in the container body may be hollow, and is formed at one of the four corners of the container. When the lid is in sealed engagement on the container, one of the lugs is aligned over the integral handle. The integral handle forms a hollow vertical pillar within the body at the one corner of the body, with the pillar defining a cavity extending from one sidewall to an adjacent sidewall. The alignment of the lugs of the lid and bail-type handle over the corners of the container, within the boundaries of the sidewalls of the container during sealing engagement of the lid on the container, also facilitates the replacement of conventional metal paint cans by the present assembly. When all elements of the assembly are aligned within the boundary of the sidewalls, the effective packing footprint of the assembly is substantially equal to that of a conventional paint can.

A method of mixing paint within the rectangular configuration of the plastic paint container and lid assembly of the present application is also provided. In the method, a weighted square sleeve within a conventional paint mixing apparatus is provided for securing the assembly during operation of the mixing apparatus to mix coating material within the assembly. The integral handle is aligned within the weighted corner of said sleeve during mixing. An alternative method for mixing is also provided wherein weighted plugs are provided within the cavity formed by the integral handle. The assembly of the present application reduces the time required for mixing by one half of the time required for mixing conventional paint cans.

Additionally, a method of storing the assembly is also provided wherein four containers are placed upon a pallet or within a box with the integral handle of each container oriented towards the exterior of the pallet or box.

These and other features and advantages will become apparent from the following figures and detailed description.

DETAILED DESCRIPTION OF THE INVENTION

Figure 1A:
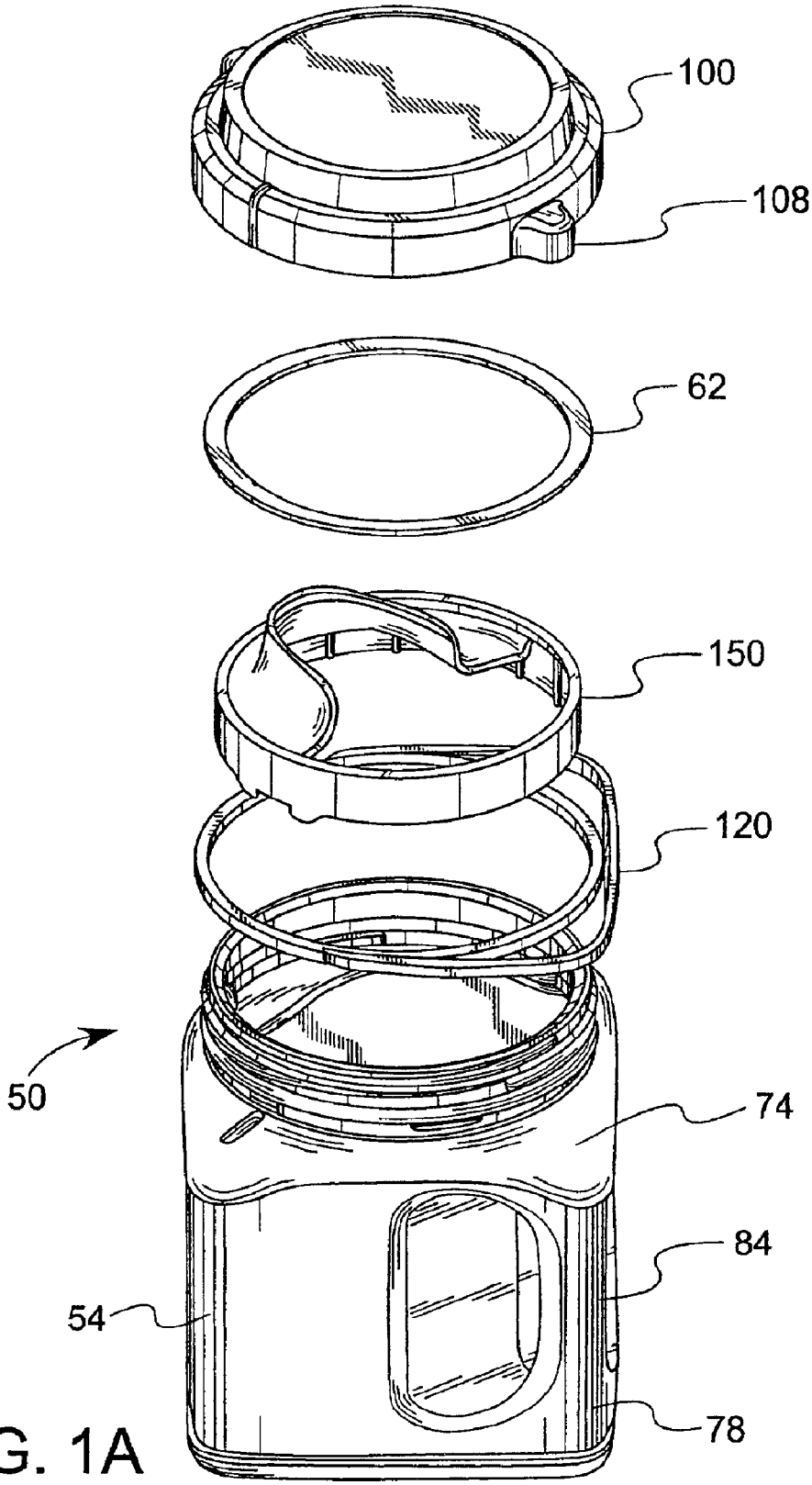
FIG. 1*a* shows an exploded view of a container of the present application.

Referring to FIG. 1*a*, a schematic view of the components of the container 50 and lid 100 assembly is shown. The assembly comprises a container 50 having a handle 84, a bail 120, an insert 150, and a lid 100 having lugs 108.

Container (and materials)

Figure 2A:
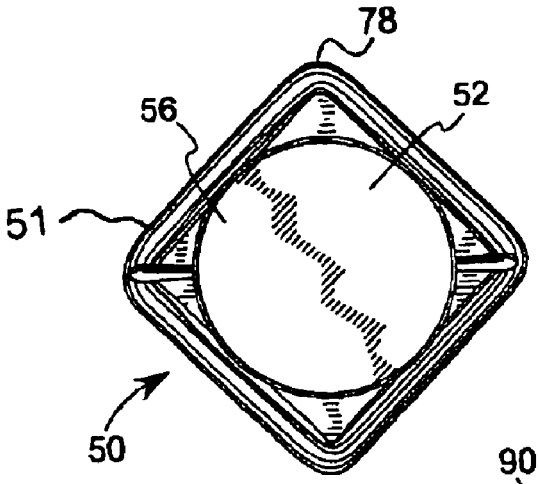
FIG. 2*a* shows a bottom view of a container.
Figure 2B:
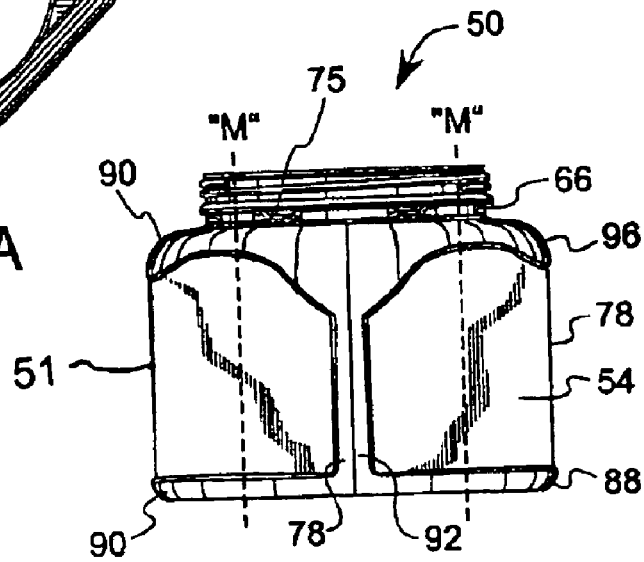
FIG. 2*b* shows a side view of a container.
Figure 3:
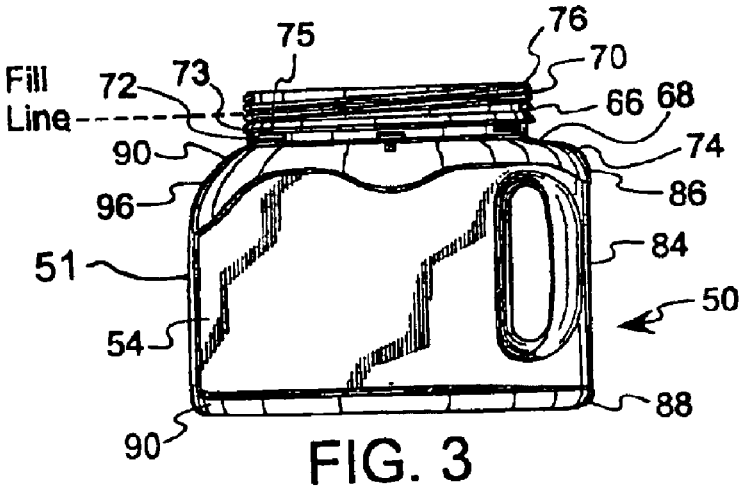
FIG. 3 shows an alternate side view of a container.
Figure 24:
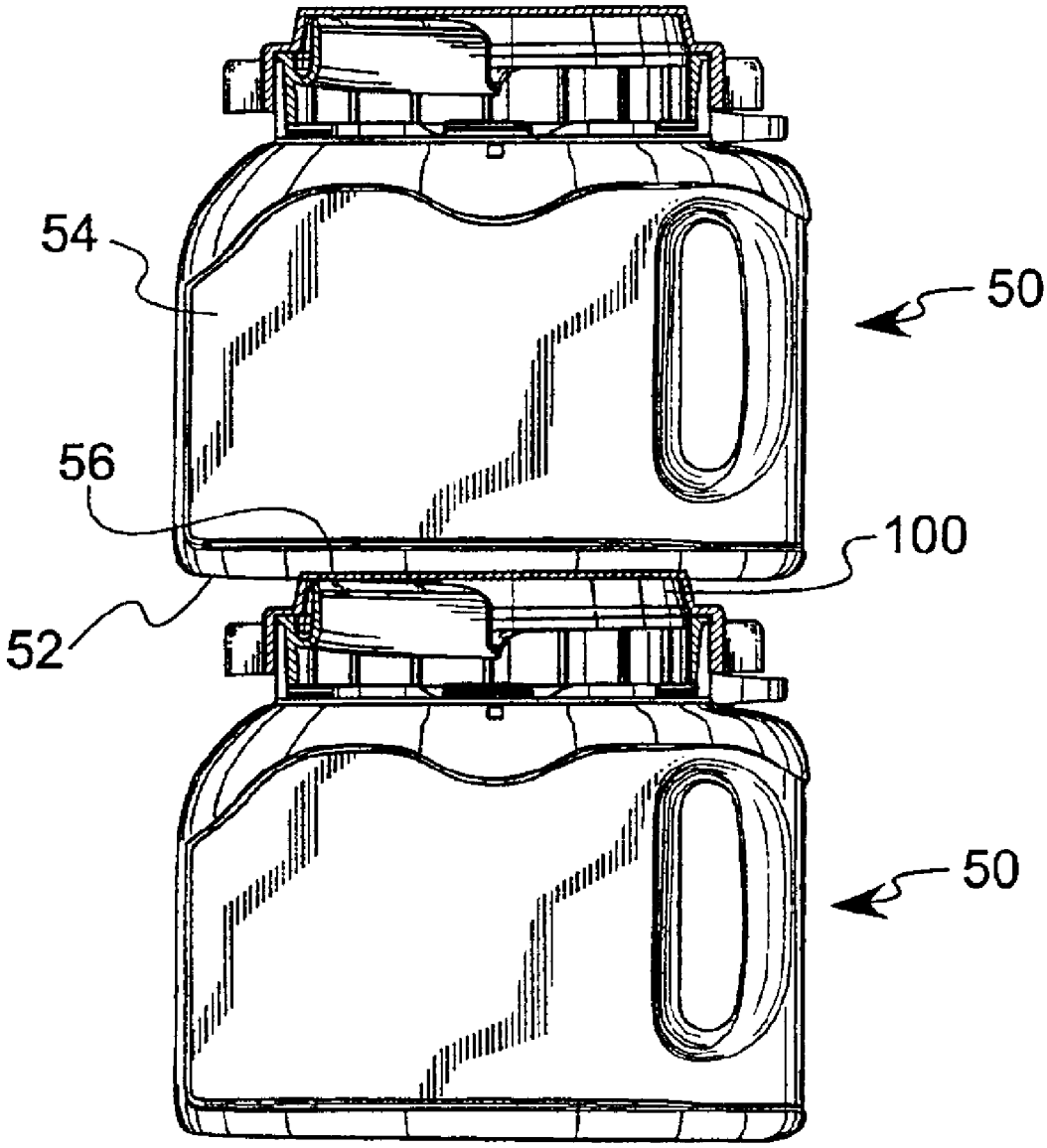
FIG. 24 shows two containers in stacked configuration.

Referring to FIGS. 2*a*, 2*b* and 3, the container 50 comprises a body 51, bottom wall 52, sidewall(s) 54, a neck 66, and one or more handles 84. In the illustrated embodiment the bottom wall 52 is square, but in other embodiments may be rectangular or circular. The body 51 is one piece and is preferably made from any polymer material which can be blow molded, for example, high density polyethylene (HDPE) or polyproylene. Use of these materials, as well as the design of the container 50, result in the container suffering a lesser amount of damage when dropped from a height of about 48 inches or about 120 cm, as compared to a conventional paint can dropped from an equivalent height. The reduction in damage reduces the number of containers returned to the manufacturer due to shipping or other damage making the product undesirable to consumers. The bottom wall 52 functions as the base of the container 50, providing stability when placed upon a flat surface. The bottom wall 52 may include an indentation 56. As illustrated in FIG. 24, the indentation 56 has a shape similar to the shape of the lid 100 so that the lid 100 of one container 50 mates with the bottom wall 52 of a second container 50 when multiple containers are stacked.

Figure 18:
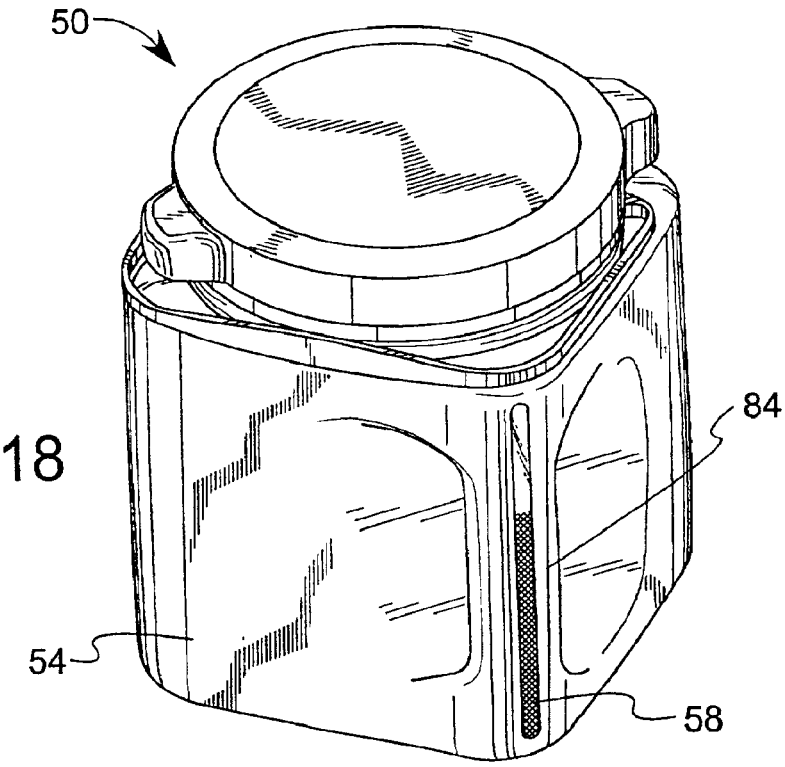
FIG. 18 shows a container with a fluid level indicator.

The bottom wall 52 of the body 51 is integrally formed with the sidewalls 54 of the container 50. Referring to FIG. 1*a*, the body 51 illustrated includes four sidewalls 54. The sidewalls 54 may be wholly or partially formed from a transparent material, such as polyethylene terephthalate (PET). The transparent material permits the liquid within the container to be observed. FIG. 18 shows a container 50 including a narrow band 58 of transparent material in the handle 84 to allow fluid level to be observed. The container 50 may additionally include graduations which allow the level of liquid remaining within the container 50 to be quantified.

Figure 1B:
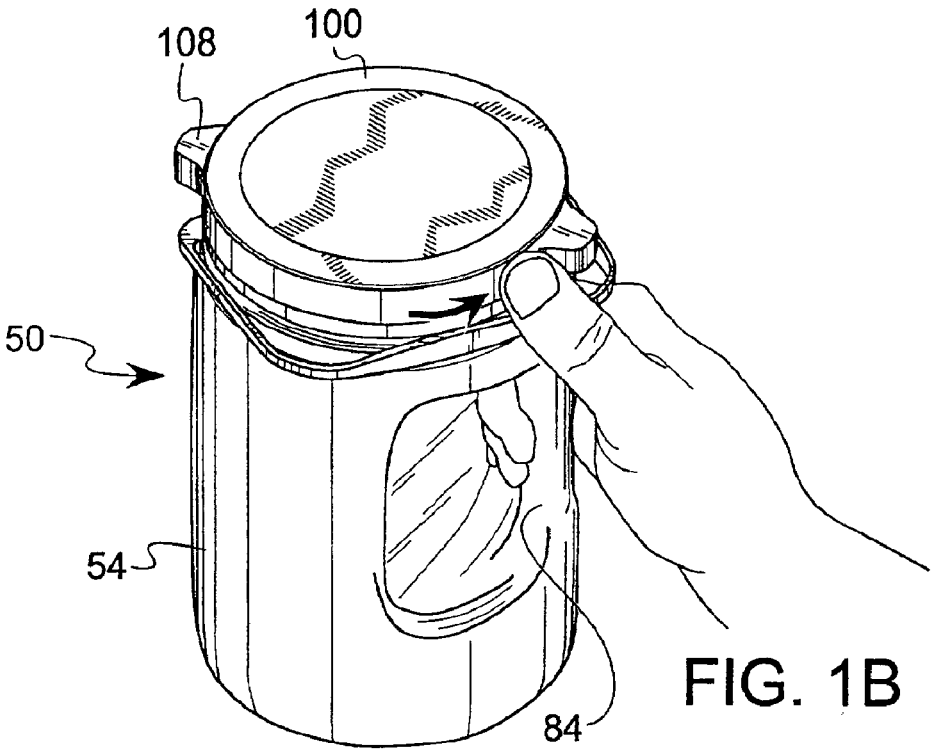
FIG. 1*b* shows a "no-tool" method of lid removal from a container.

The number and shape of the sidewalls 54 depend upon the overall shape of the container 50. A round container 50, as shown in FIG. 1*b* includes a single sidewall 54 while a rectangular container 50 shown in FIG. 1*a* includes four sidewalls 54. The sidewalls 54 illustrated in FIG. 1*a* have a flat smooth surface. Alternatively, the sidewalls 54 may be slightly contoured and somewhat roughened or textured, as illustrated in FIG. 2*b*, to facilitate the application of labels and the like and simplify a method of blow molding the sidewalls 54. In a rectangular shaped embodiment with more than one sidewall 54, each sidewall 54 meets an adjacent sidewall 54 at a corner 78. The rectangular shaped embodiment provides increased visibility for labels attached to sidewalls 54 as compared to a conventional cylindrical paint can. Such increased visibility provides sales and marketing advantages, as the consumer is more readily able to read and review the material provided on a flat container label.

The corners 78 in the illustrated embodiment are preferably rounded for increased strength, which may be required when the filled containers 50 are compressed during stacking. Additionally, while the corners are rounded, the amount of rounding cannot be so great as to decrease the required volume of the container. Where the container 50 is for replacement of a conventional paint can which holds one (1) gallon of paint, the container requires a volume of at least 139 ounces, which provides for some head space between the fluid level and lid 100. In the preferred embodiment, each corner 78 may be rounded to a radius of approximately 0.75 inches (19 mm).

Figure 20:
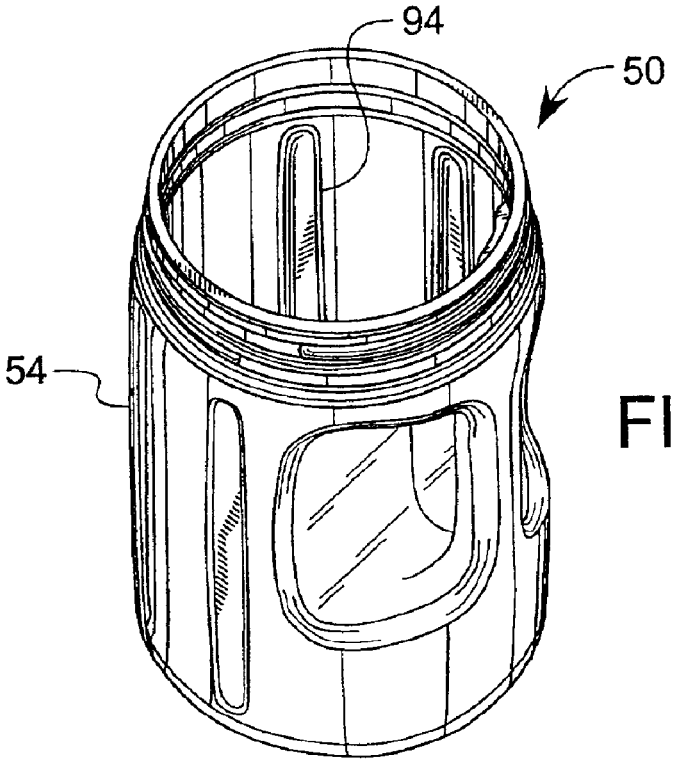
FIG. 20 shows a container with internal ribs.

Additionally, the sidewalls 54 illustrated in FIGS. 2*b* and 3 are also recessed, such that the top and bottom portions 86 and 88 of the container 50 which include rounded corners form horizontally strengthening ribs 90. The ribs 90 horizontally surround the top and bottom portions 86 and 88. Additionally, a vertical rib 92 may be provided between the top and bottom portions 86 and 88. FIG. 2*b* shows an exteriorly projecting rib along the corner opposite an integral handle 84. FIG. 20 shows numerous interiorly projecting ribs 94 on a container 50. Interiorly projecting ribs 94 add strength to the container 50 and aid in the fluid mixing process by breaking up fluid streams along the sidewalls 54 of the container 50. The corner 96 opposite the integral handle 84 in the FIG. 3 container embodiment may be contoured with a lower profile to avoid becoming a barrier or interference to liquid as it is being poured from the container 50. In the rectangular embodiments of the present application, each sidewall 54 also has an imaginary middle line "M" which extends from the top of the sidewall 54 to the bottom of the sidewall 54. The middle line "M" is positioned equidistant from each corner 78 of the sidewall 54. When the lid 100 of the container 50 is screwed into a sealed position, the lugs 108 of the lid 100 may be aligned with the corners 78 between the sidewalls 54 or the middle lines "M" of a sidewall 54, depending on the embodiment.

Container Interchangability with Conventional Paint Cans

Figure 10:
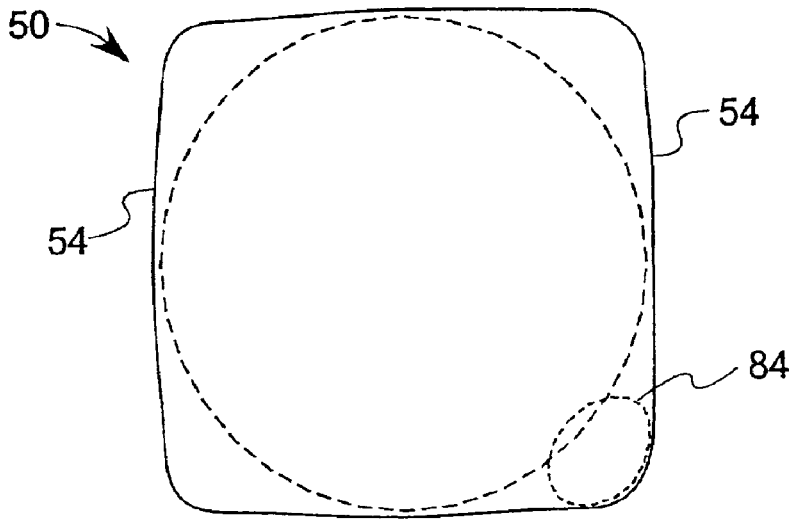
FIG. 10 shows the footprint of the container of the present application, as compared to a conventional paint can.

Referring to FIG. 10, the container of present application is preferably sized to easily replace conventional cylindrical metal paint cans due to its substantially equal effective packing volume. The effective packing volume includes the effective packing "footprint" (a function of width and depth) of the container, as well as the effective packing height of the container, and is comparable to the footprint and height of a conventional metal paint can. The effective packing volume is a product of effective packing footprint times the effective packing height. The effective packing volume is important for aspects of manufacture, manipulation, storage, and use of the present container as a substitute for a conventional metal paint can. With a substantially equal packing volume, the present container may often be handled in conventional machinery, as well as packed, filled, labeled, shipped, displayed, handled, and used in ways which are conventional and currently in use by manufacturers, retailers and consumers. Embodiments of the container 50 "match" the effective packing volumes of conventional paint cans which hold one gallon or one quart, as well as metric sized cans which are standard in Europe and other parts of the world. The dimensions of a conventional one gallon cylindrical paint can, having a circular cross section, are approximately a height of 7.68 inches and a diameter of approximately 6.63 inches. The circular cross section of the conventional can may be inscribed within the cross section of the rectangular container 50 embodiment of the present application, resulting in substantially equal effective packing footprints. The depth and width of the rectangular container embodiment are substantially equal to the diameter of the conventional cylindrical can, providing a one quarter inch margin for manufacturing tolerances. The effective packing height, which is equal to the height of the container and lid assembly combination, of the rectangular container embodiment will likewise be substantially equal and within one quarter inch of the effective packing height of the conventional can and lid. Thus, for example, despite the very different geometry of the container 50 and its integral handle 84, the container holds an amount of material which is identical to the amount conventional cylindrical metal can may hold—one gallon—while leaving sufficient "head space" between the lid 100 and the fluid material within container 50 in each. The effective packing volume is also substantially equal. With a substantially equal packing volume as compared to a conventional can, the container 50 of this application may readily replace conventional cans.

Integral Handle

Figure 6:
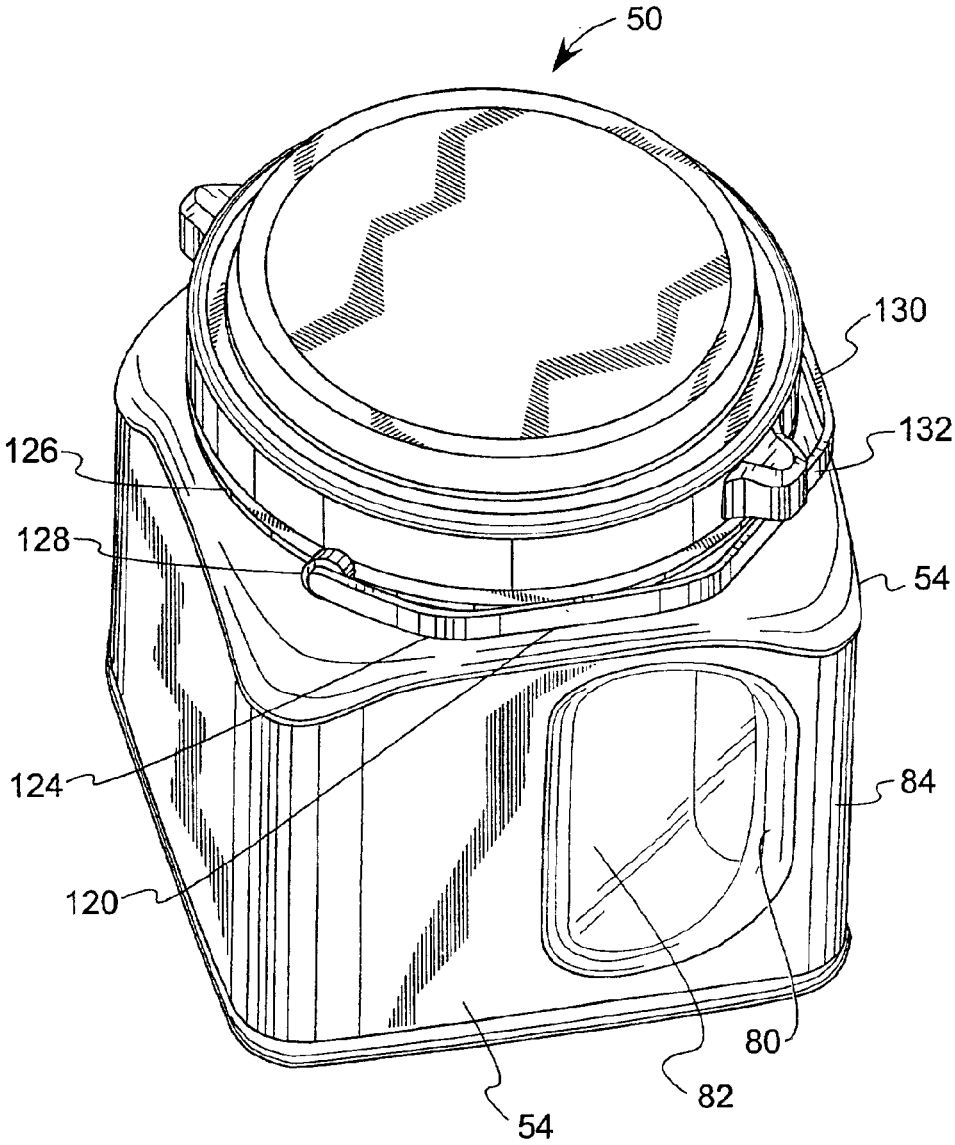
FIG. 6 shows a perspective view of a container with an embodiment with a two-piece bail-type handle.

The illustrated container 50 of FIGS. 1*a–c*, 2*a–b* and 6 includes an integral handle 84. The integral handle 84 may be a vertical pillar within the container and formed on one corner 78 of the container 50. The integral handle 84 may be hollow or solid, but is preferably hollow to facilitate mixing of the liquid within the container 50. Like the container 50, the handle 84 may be wholly or partially transparent. The handle 84 is sized to allow comfortable gripping by a variety of consumers. The handle 84 greatly adds to the overall strength of the container 50, particularly with respect to vertical loads. The handle 84 is rounded in cross-section for comfortable handling. Referring to FIG. 6, the handle 84 includes an interior face 80 which defines part of a cavity extending from one sidewall 54 to an adjacent sidewall 54. The cavity is also formed by an interior wall 82 extending from one sidewall 54 to an adjacent sidewall 54. The illustrated interior wall 82 is planer.

Figure 12:
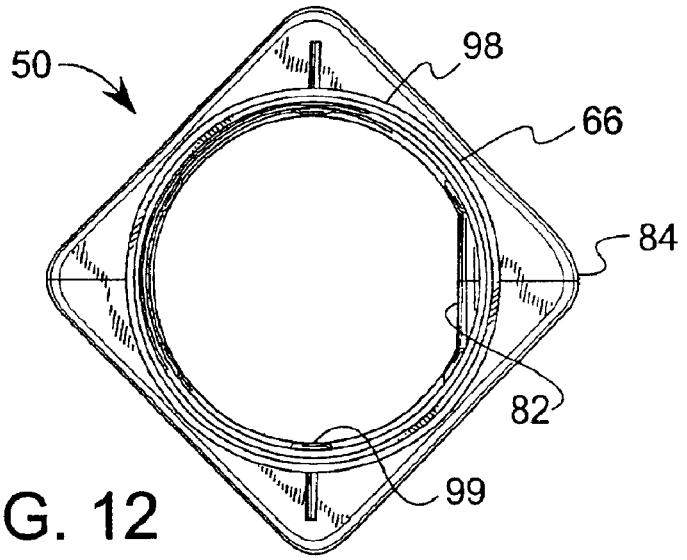
FIG. 12 shows a top view of an open container of the present application.

As shown in FIG. 12, the neck of the container defines a wide mouth opening which has a diameter which is so large that the interior wall 82 extends into the diameter of the wide mouth opening. The integral handle 84 may be used in conjunction with or as a replacement for a second handle of a bail-type handle 120 described in more detail below.

Container Neck

The sidewalls 54 of the container 50 merge into an integral neck 66 as shown in FIG. 3. The neck 66 includes a vertical portion 70 which has a wide mouth opening. The neck 66 has a diameter which is less than that of the container 50 at its sidewalls 54. The sidewalls 54, at the top portion 86 which is intermediate the sidewalls 54 and the neck 66, may be rounded for strength and to produce a smooth junction between the sidewalls 54 and the neck 66. Similarly, the corners 74 at the junction of the sidewalls 54 in the top portion 86 are also rounded. Although rounded, the corners may be sharply angled to maximize the volume capacity of the container. One or more of the corners 74 may also be recessed relative to the other sidewall dimensions, as previously discussed, to allow for appropriate clearance for a paint stream as it is poured from the container 50 or a spout 160. As the diameter of the neck 66 is somewhat smaller then the width of the container 50, a horizontal portion 68 is provided between the neck 66 and the sidewalls 54, spanning the distance between a vertical portion 70 of the neck 66 and the top of the sidewalls 54. The length of this horizontal portion 68 varies, depending upon the difference between the width between opposite sidewalls 54 of the container 50 and the diameter of the neck 66 at its vertical portion 70.

Figure 13:
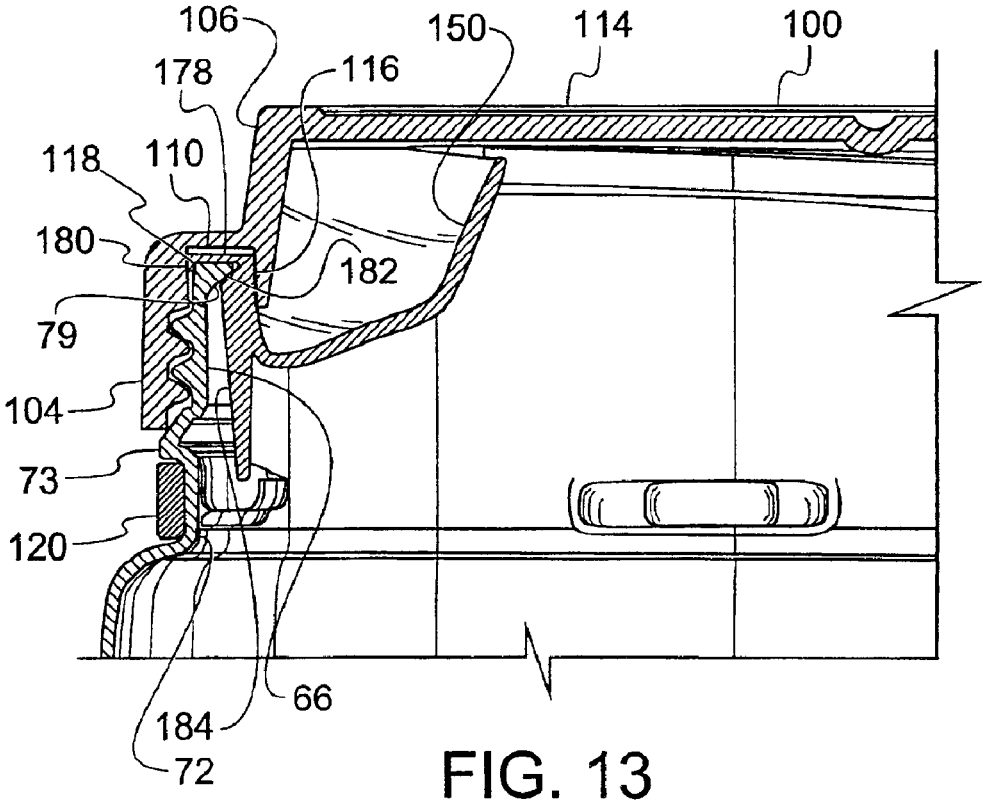
FIG. 13 shows a cutaway view of an insert and lid secured in place on a container.

The vertical portion of the neck may include a physical or imaginary "fill line" for liquid placed within the container 50. In a rectangular embodiment of the container 50, the fill line for 128 ounces of fluid is located less than one inch from the top of the neck, and preferably approximately 0.77 inches from the top of the neck 66. The fill line for 131 ounces of fluid, the theoretical maximum coating material and pigment amounts required to create any shade of tinted material, is preferably approximately 0.56 inches from the top of the neck 66. The vertical portion 70 of the neck 66 also preferably includes a bail seat 72. The bail seat is a portion of consistent vertical diameter on the neck 66 and onto which a bail type handle 120 may be attached. As shown in FIG. 13, the bail seat may be bordered on its top side by a lip 73. The lip 73 has a diameter which exceeds that of the bail seat 72, thus, allowing the bail handle 120 to snap over the lip 73 into a locked position on the bail seat 72. The bail 120 may be snapped into position by manual application of force or by the action of the lid 100 being screwed onto the container 50. A bail handle 120 may rotate freely about its seat 72, as in the embodiment of FIGS. 1*a* and 1*b*, or may be keyed to the seat for specific alignment on the container body 51, as in FIG. 6. In the fixed bail handle embodiment shown in FIGS. 3, 6 and 7*b*, a tab 122 extending from the bail 120 fits within an indentation 75 on the seat 72 in the neck 66 or vise-versa. Referring back to FIG. 3, the neck 66 includes a threaded surface 76 above the lip 73. The threaded surface 76 may include a single continuous thread to secure and seal the lid 100 into a closed position upon the container 50. In the preferred embodiment, the threaded surface 76 comprises a double helix thread. The double helix thread ensures that the lid 100 begins to engage the neck 66 at a predetermined position, such that when the lid 100 completes its rotations on the neck threads 76 and is tightly sealed, the lugs 108 upon the lid 100 are positioned at a predetermined location. In the preferred embodiment of a lid 100 with two lugs 108, the predetermined location of the two lugs 108 in sealed position is with one aligned over the integral handle 84 and another over a corner opposite the integral handle, as illustrated in FIG. 6.

Figure 23:
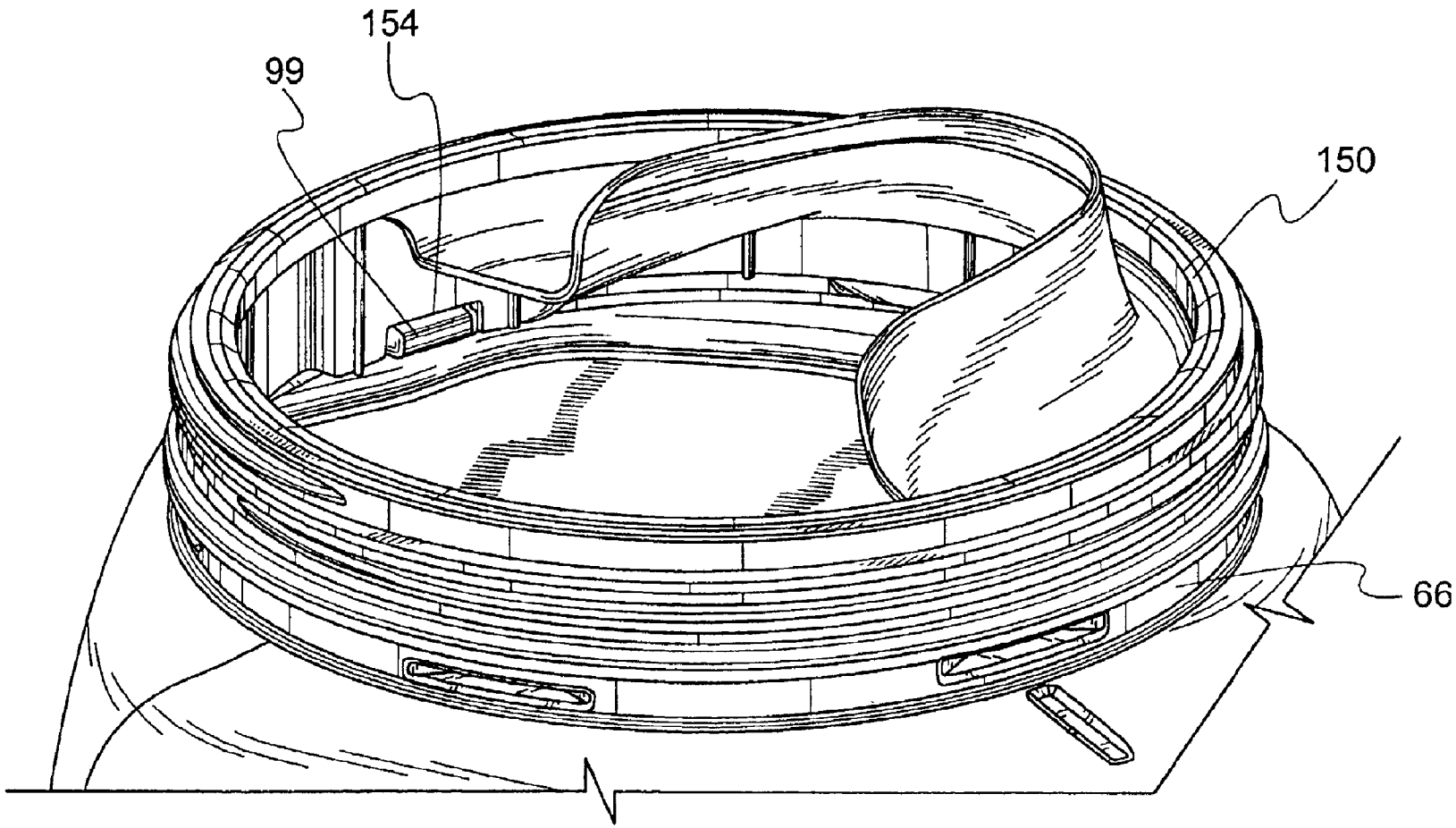
FIG. 23 shows the insert in position within the neck of the container.

Referring to FIG. 12, the interior of the neck 66 of the container 50 may include numerous insert seats 98. The insert seats may be projections extending from the interior surface of the neck 66. The insert seats 98 provide a place for an insert 150 to rest. The neck 66 may also include one or more tabs 99 extending from its inner surface. One tab 99 is designated to mate with a mating notch 154 formed in the insert 150 to help position the insert 150 into a desired orientation as shown in FIG. 23. An embodiment of the neck 66 with more than one tab 99 will only have a single tab 99 which is sized to mate with the notch 154 upon the insert.

Container Inserts

FIGS. 4*a*–4*e* show one type of insert 150 which may be placed within the neck 66 of the container 50. The insert 150 may be manufactured by injection molding from polypropylene. The insert 150 includes an outer wall 152 around the outside which when the insert is in place abuts the inner surface of the neck 66. The outer wall 152 may define a notch 154 in one position along its bottom. This notch 154 mates with the tab 99 of the neck 66, as described above, to align the insert 150 in a desired position as shown in FIG. 23.

Referring back to FIGS. 4*a*–*e*, in one embodiment of the application, the insert 150 also includes a spout 160. The spout 160 may be formed as part of a web 156 extending across a portion of the insert interior. The web 156, and the radial extension of the spout 160, does not exceed the diameter of the outer wall 152. The height of the spout 160 may, however, extend above the top of the insert outer wall 152. For example, the spout portion extends radially upward from the wide mouth opening by a distance less than the radius of said insert. The spout 160 may be a portion 172 of the interior of the web 156, which is flared upwardly. As the flared portion 172 extends upwardly, it may become more vertical which helps provide a preferred stream profile when liquid within the container 50 is poured. The top of the flared portion 172 of the spout 160 is slightly angled from front to rear to lessen the chance of scraping the spout 160 insert against the underside of the lid 100 when the lid is threaded into engagement on the neck 66 of the container 50.

Figure 4D:
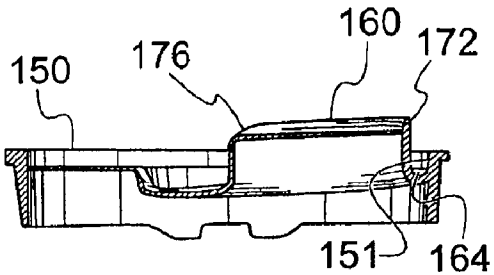
FIG. 4*d* shows a cutaway view of the container insert.
Figure 4E:
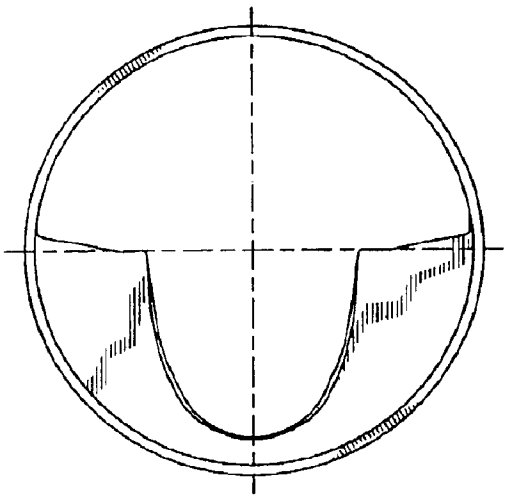
FIG. 4*e* shows a top view of an alternate insert embodiment.
Figure 4C:
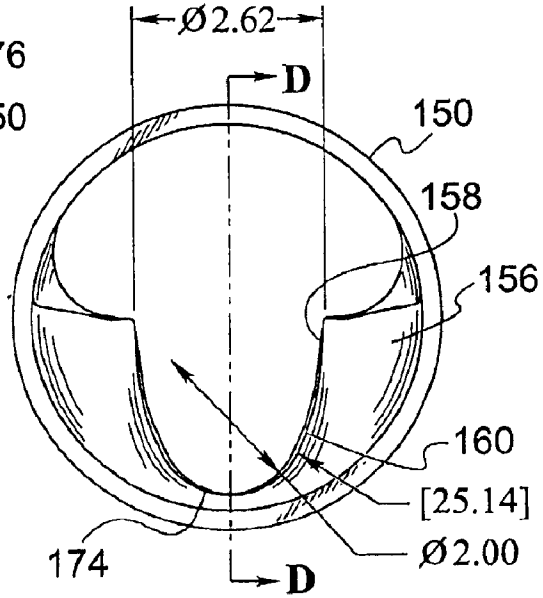
FIG. 4*c* shows a top view of the container insert.
Figure 4A:
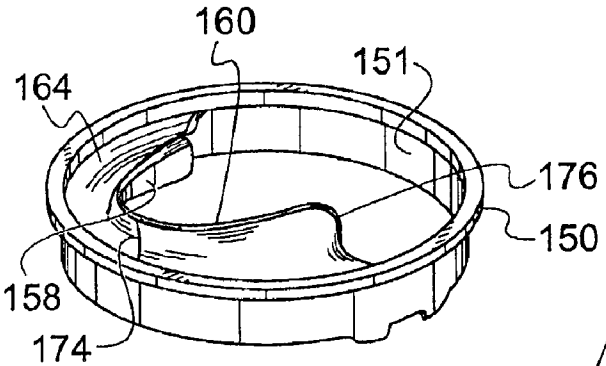
FIG. 4*a* shows a perspective view of one embodiment of a container insert.
Figure 4B:
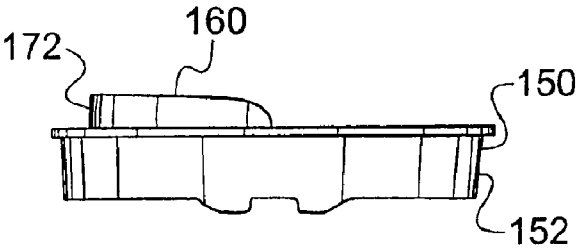
FIG. 4*b* shows a side view of the container insert.

The spout 160 has an arcuate shape in horizontal cross section. FIG. 4*c* shows the spout 160 having a preferably "U" shape in horizontal cross section. In one embodiment of the application, the distance from the spout's cusp 174 to an imaginary line between the two rear edges 176 of the spout is approximately 2 to 3 inches or 2.4 inches, and the radius of curvature of the spout 160 at the cusp 174 is approximately 1 inch or about 2.5 cm. The spout 160 may have a narrow diameter of about two inches to restrict undesired large flow rates of paint and to provide a smooth pouring stream. The spout 160 may have rounded rear edges 176 to provide superior strength and minimize interference with a brush being dipped into the container 50. Specifically, a large brush, such as a 4 inch wide or 10 cm wide brush, should be easily permitted access into the container 50 through the spout 160 or other insert 150, into the container interior. As shown in FIGS. 4*a*–*e*, extending from its top to bottom on its interior surface 158, the spout 160 may be contoured to provide a desired shape to assist in the pouring of paint. The spout 160, at its cusp 174, has a small thickness of approximately 0.03 inches (0.76 mm) to prevent excessive dripping of a terminated paint stream. Smaller thicknesses become difficult to injection mold. As shown in FIG. 4*d*, extending from its top to bottom on its exterior surface, the spout 160 may be contoured to provide a desired shape for draining paint or other coating material back to the interior of the container 50 following the pouring process. The spout 160, in this regard, works in conjunction with a flowback channel 164 within the web.

The flowback channel 164 extends from the base of the spout 160 to the inner wall 151 of the insert 150. The flowback channel 164 may completely surround the spout 160 and is outside of, and beneath the spout 160. The flowback channel 164 may have a curved base. Within the web 156, the flowback channel 164 may be pitched from a higher position at the front to a lower position at the rear of the web to 156 ensure that following pouring, the liquid within the flowback channel 164 is returned to the container interior.

Figure 5:
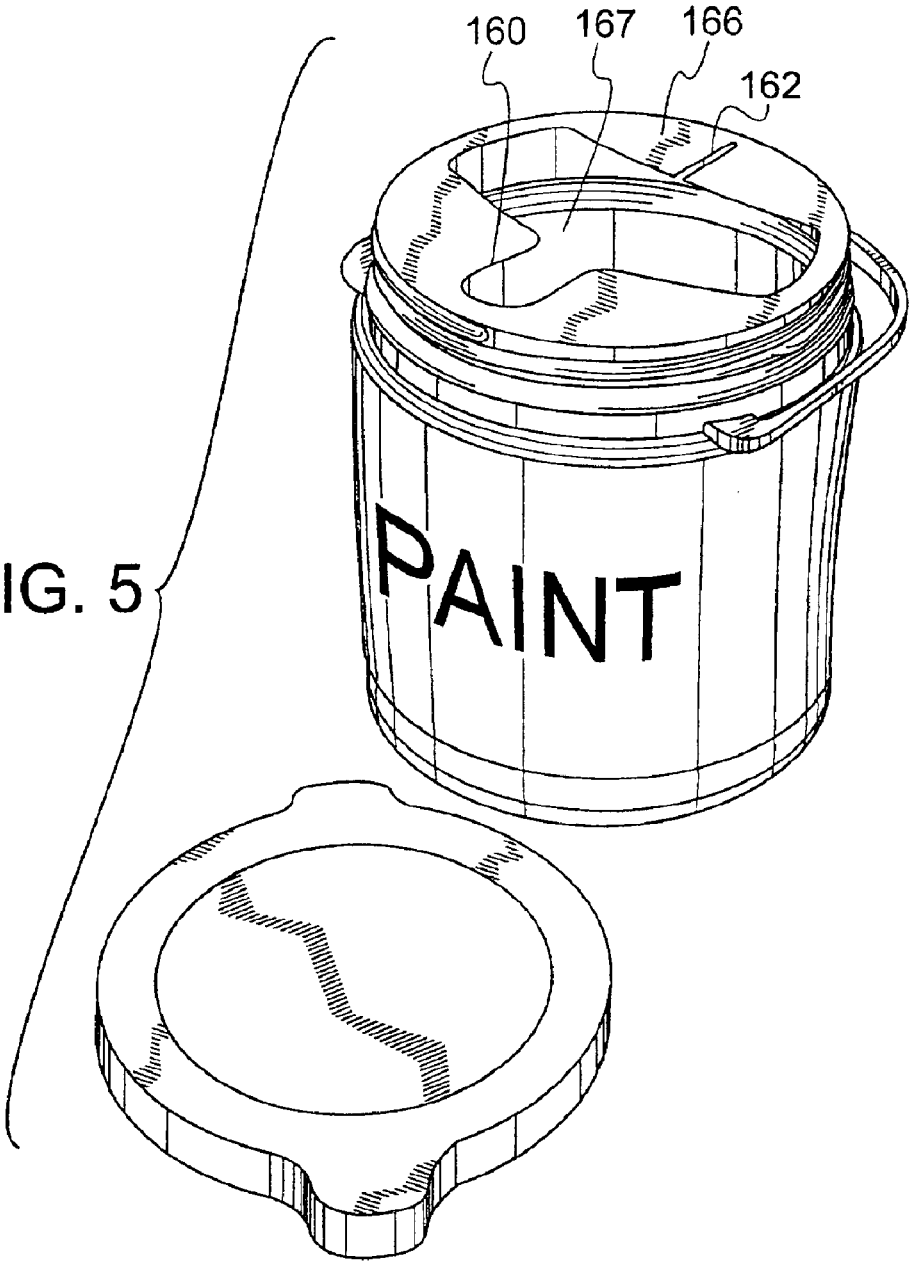
FIG. 5 shows an alternative embodiment of a container insert.

In another embodiment of an insert, as shown in FIG. 5, the insert 150 may include a flat upper surface 166 which defines a multi-functional opening. A forward pouring section of the opening functions as a spout 160'. This spout 160' embodiment does not extend upward from the insert upper surface 166. A transverse section of the opening functions as passage for entry of a brush. The flat backwall 167 of the transverse portion of the opening can be used to wipe a portion of paint off a dipped brush. A rear portion of the opening functions as a stirring stick scraper 162. The rear portion of the opening is very narrow and is oriented transversely from the section allowing passage of the brush.

Bail Handle

Figure 7A:
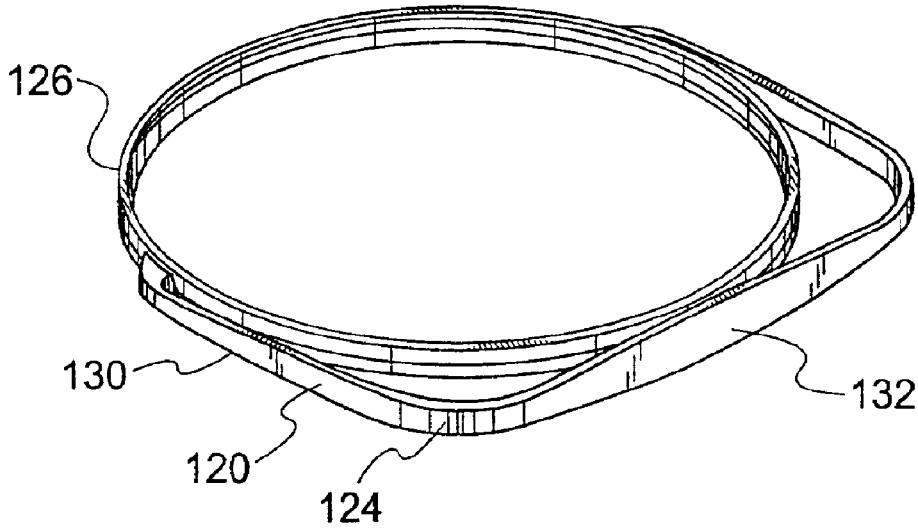
FIG. 7*a* shows a perspective view of an embodiment of a one-piece bail-type handle detached from a container.

Referring to FIG. 6, a handle, also referred to as a bail or bail-type handle, 120 may be used to lift the container 50. The bail 120 may be manufactured by an injection molding process, of materials such as polyethylene. The bail 120 includes an arcuate member 124 which may be directly affixed to the neck 66 of the container 50 or affixed to a hoop 126. The hoop 126 and arcuate member 124 may be formed from a single piece of polymer or multiple pieces. In a single piece embodiment, shown in FIG. 7*a*, the arcuate member 124, in a non-lifted state, rests generally parallel with the major plane of the hoop 126. The single piece embodiment may be manufactured from medium density polyethylene (MDPE). As the bail 120 is lifted, the arcuate member 124 twists near the joint with the hoop 126, and becomes generally perpendicular to the hoop 124. The hoop 124, which may be manufactured from high density polyethylene in a multi-piece embodiment, circumscribes the neck 66 of the container 50 and abuts the bail seat 72 as described above.

Figure 7B:
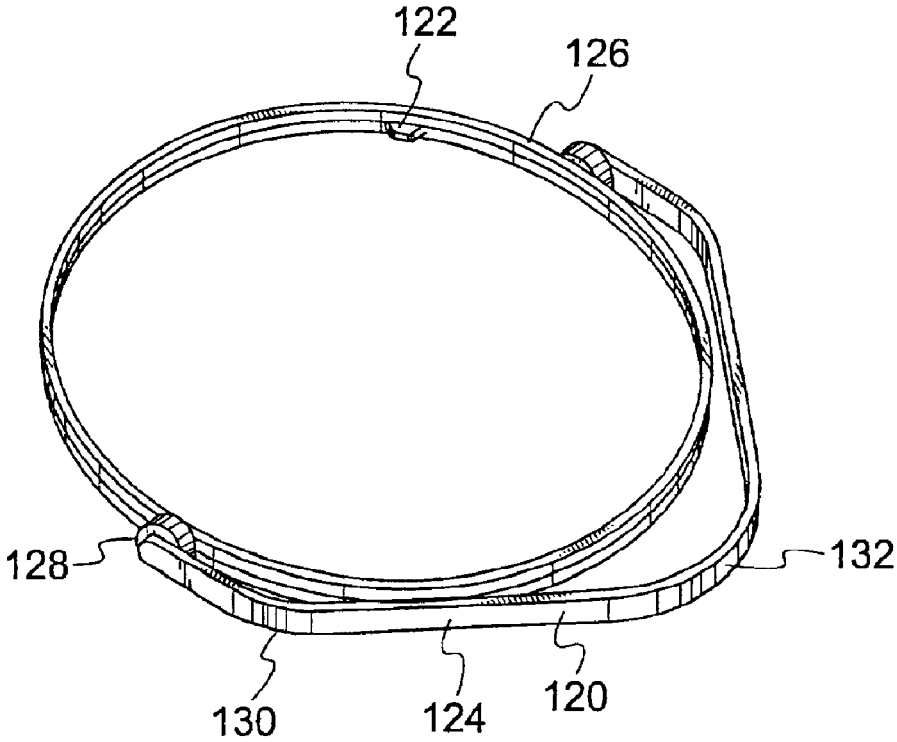
FIG. 7*b* shows a perspective view of the embodiment of a two-piece bail-type handle detached from a container.

In a multiple piece embodiment, shown in FIGS. 6 and 7*b*, a socket and disc joint 128 may join the arcuate member 124 to the hoop 126. The arcuate member 124 may have a continuous variable cross section and may be manufactured from low density polyethylene for comfort. The arcuate member 124, although integrally formed, may include a plurality of different shaped subsections 130. These subsections 130 may be curved and/or straight. The arcuate member 124 may include a central subsection 132 which may be flat or may be curved. In a preferred embodiment, the central subsection 132 is wider and thicker than the remaining subsections 130. The central subsection 132 may also be rounded on its underside to provide comfort during manual lifting of the container 50. When the central subsection 132 is arcuate, the bail handle 120, when extended such that the container 50 is hung from an object or carried by a user, easily centers itself with respect to the object to provide stability to the hanging container 50. The central subsection 132 may also be oversized with respect to the rest of the bail handle 120 to provide comfort during carrying by hand.

The arcuate member 124 of the bail 120 may be free swinging or may toggle over an edge of the neck 66 of the container or a lug 108 on the container lid 100. This toggle feature prevents undesired swinging of the bail 120. Also in a separate embodiment of the application shown in FIG. 6, the arcuate member 124 of the bail 120 may be locked in lowered position by one or more lugs 108 upon the lid 100 or may be free to swing over and around the lugs 108. The socket and disc 128 of the bail 120 may be shaped to provide a preferred resting point along a path of swing, such as a position where the arcuate member is raised directly vertical. The arcuate member 124 and hoop 126 may be two separate pieces easily snapped together at the disc and socket joint.

The bail 120 may preferably be sized to have a maximum width which does not exceed the width from sidewall to sidewall within a rectangular embodiment of the container. Similarly the bail 120 may preferably be sized to have a maximum width which does not exceed the diameter of the sidewall in a cylindrical embodiment of the container.

Lid

Figure 8A:
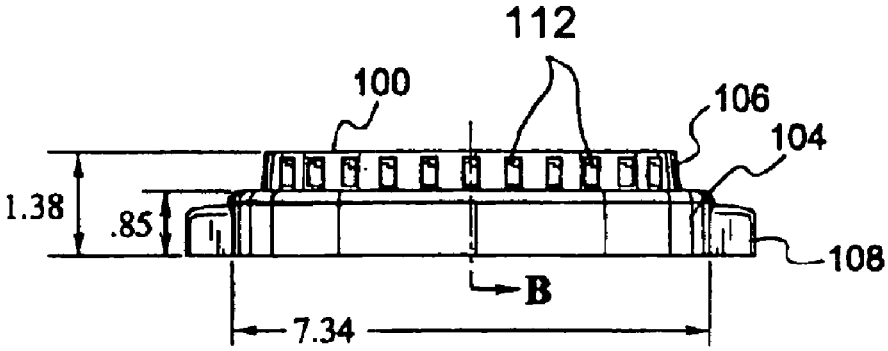
FIG. 8*a* shows a side view of a container lid.
Figure 8B:
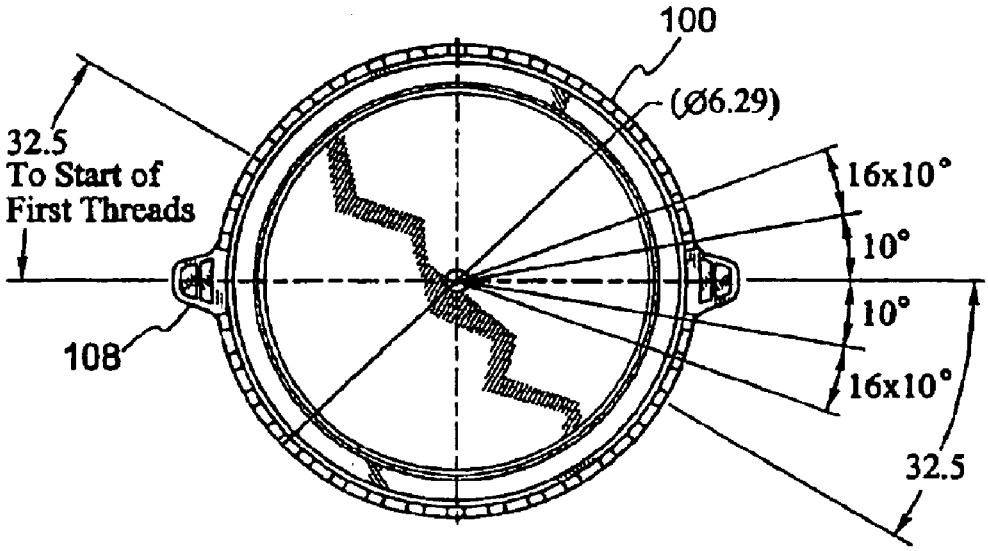
FIG. 8*b* shows a bottom view of a container lid.
Figure 8C:
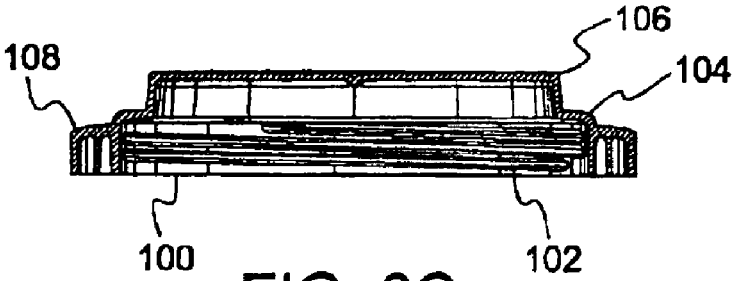
FIG. 8*c* shows a cutaway view of a container lid.
Figure 19:
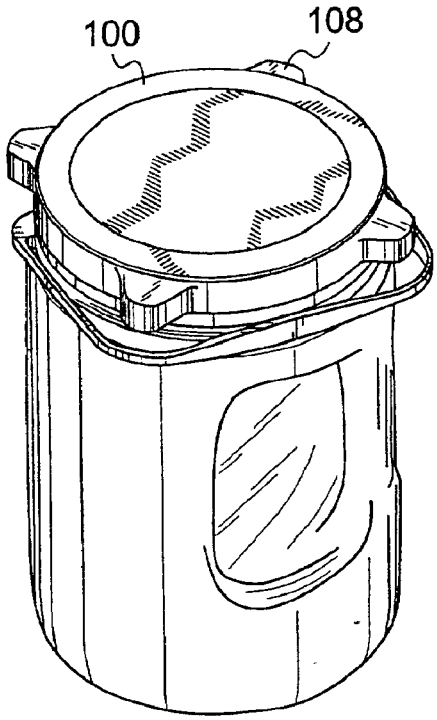
FIG. 19 shows a container with an alternate lid embodiment.
Figure 25C:
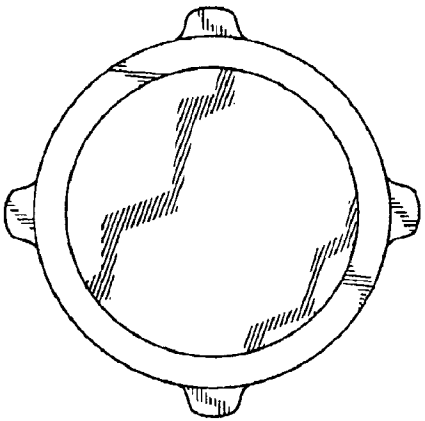
FIGS. 25*a* to 25*d* show various alternate container and lid configuration embodiments.
Figure 25D:
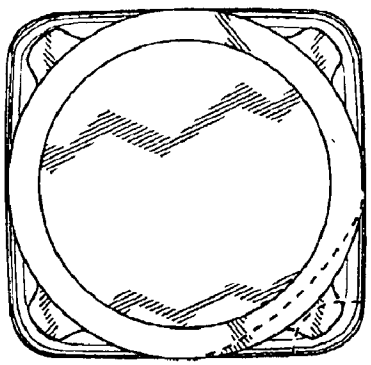
Figure 25A:
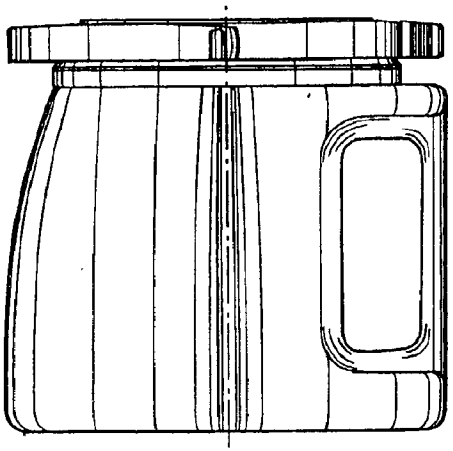
Figure 25B:
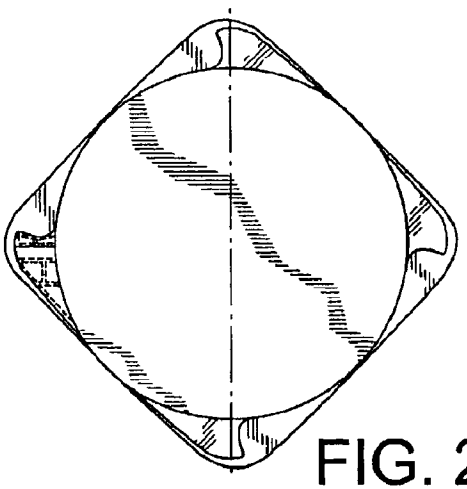

Referring to FIGS. 8*a–c* a lid 100 may be shown which is engaged with the threads 76 on the neck 66 of the container 50. The lid 100 may be formed by an injection molding process, and manufactured from materials such as polypropylene. The lid 100 may have a substantially flat surface, as shown in FIG. 1*b*, or a stepped top surface having raised gripping ribs as shown in FIGS. 8*a–c*. In the FIGS. 8*a–c* embodiment, a lower section 104 and an upper section 106 are provided. The upper section 106 provides clearance for the spout 160 of the insert. The side of the upper section 106 mates with the bottom wall 52 of an adjacent container 50 for stability in stacking as previously stated. The upper section 106 may have a diameter which is less than the lower section 104. The lower section includes 104 a plurality of lugs 108 extending radially outwards from an exterior surface. The lower section 104 may include interior threads 102 which communicate and mate with the double helix threads 76 on the neck 66 of the container 50. As previously stated these threads 102 may be in a double helix to enable precise positioning upon tight or sealing engagement of the lid 100 on the container neck 66. The preferred embodiment of the lid 100 includes two lugs 108. An alternate embodiment includes four lugs 108 as shown in FIGS. 19 and 25*d*. The lugs 108 may be evenly spaced about the circumference of the lid.

Figure 1C:
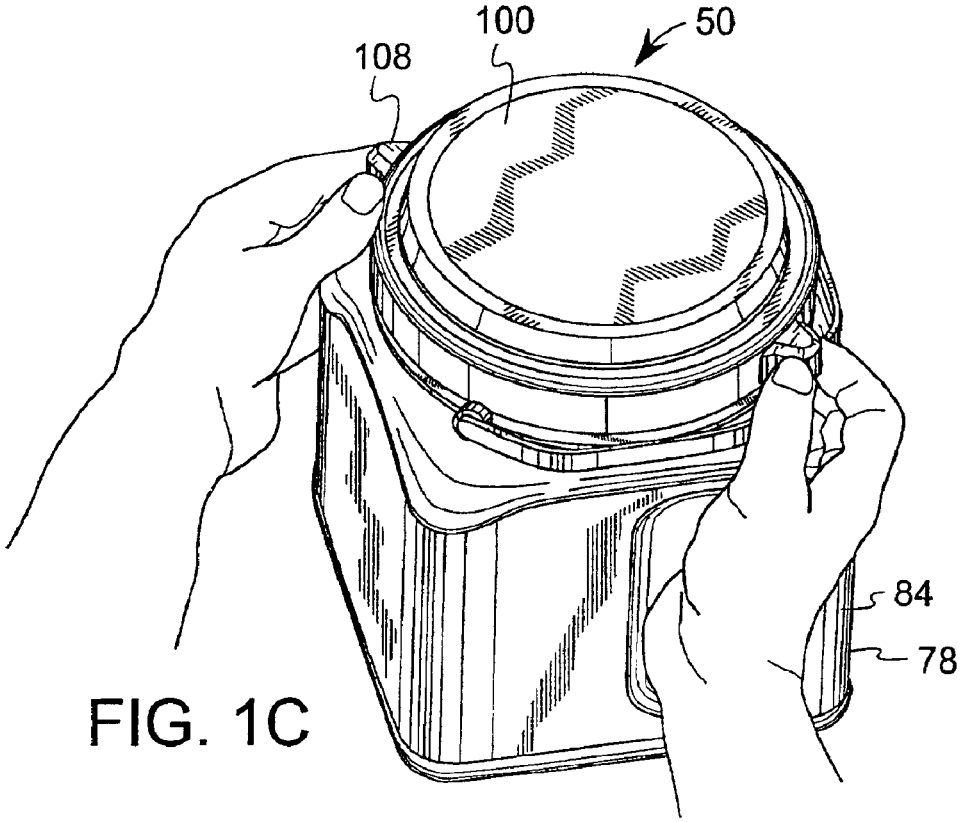
FIG. 1*c* shows a second "no-tool" method of lid removal from a container.

FIG. 1*b* illustrates the hand opening of the container using the lugs 108 on the lid 100. By providing a container 50 with a lid 100 that can be opened by hand, no tools are required, which in a conventional metal paint can are typically required, and also have a tendency to damage the paint can during opening. Thus, the container 50 and lid 100 assembly of the present application provide for "no-tool" opening. In a closed position, a lug 108 upon the lid of the container may be within the reach of a user's thumb who is grasping the integral handle 84 of the container 50. The lugs 108 also are within the width of the sidewalls of the rectangular container when the lid 100 is in a sealed position, although the lugs 10 may exceed the width of the sidewalls during application or removal of the lid 100. By sweeping his or her thumb in different directions, the user may apply force to either side of the lug 108 and in doing so open or seal closed the container lid 100. This method is equally effective when the integral handle 84 is grasped with either the user's left or right hand. When additional force is required, both of the user's hands may be laid upon opposite corners of the container 50 as shown in FIG. 1*c*. The desired corners are aligned with the lugs 108 upon the lid 100. Force is applied to the lugs 108 by the thumb upon one of the user's hands and the finger upon the opposite hand to remove or seal the lid into place. In a desired embodiment, the lid 100 may be moved from a sealed position by rotation of between one half and three quarter turns or revolutions to a position where removal is possible.

As shown in FIG. 13, a horizontal seat 110 extending between the base of the upper section 106 and the top of the lower section 104 provides a resting place and sealing point for an insertable elastomeric or flexible seal 62 which may be used in the same embodiment of the application. The seal may compress against a flat surface upon the insert 150. The exterior surface of the upper section may include a plurality of ribs 112 as shown in FIG. 8*a*. These ribs 112 make gripping the lid easier. The smaller diameter of the upper section 106 provides a gripping space for an individual with a smaller hand. The ribs 112 also provide mold release advantages in manufacturing. The top 114 of the lid 100 may include a recess to receive a label.

Mixing Coating Materials

Figure 9A:
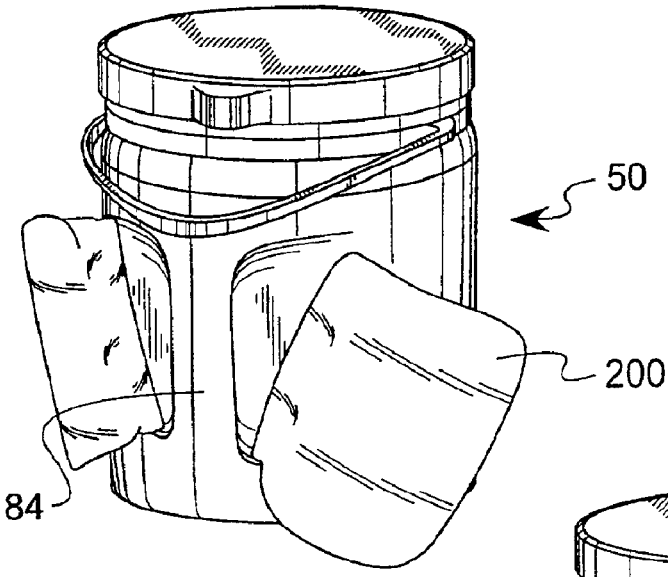
FIG. 9*a* shows a side view of a container with handle plugs used during mixing of paint within the container in a shaker apparatus.
Figure 9B:
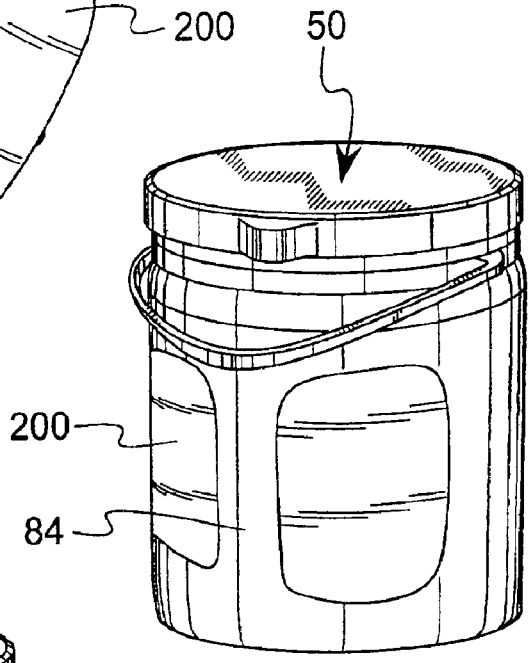
FIG. 9*b* shows a side view of a container with handle plugs in position and ready for placement into shaker apparatus.
Figure 9C:
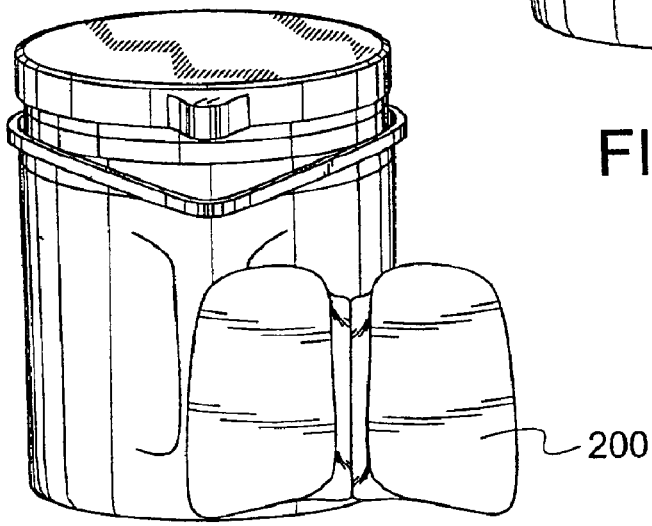
FIG. 9*c* shows handle plugs apart from a container.
Figure 21:
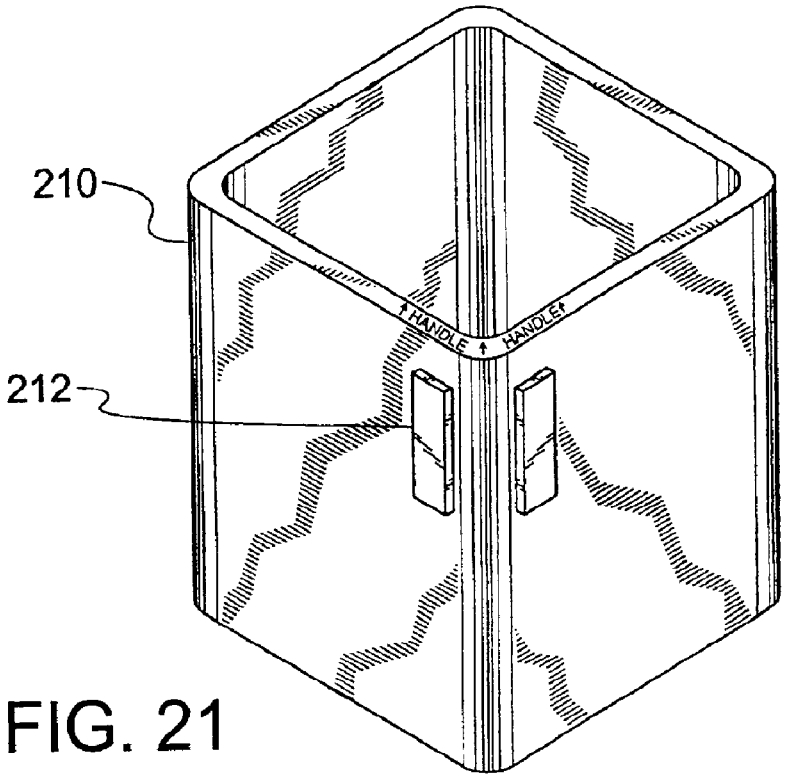
FIG. 21 shows a retrofit sleeve insert for a shaker machine.

Referring to FIGS. 9*a*, 9*b*, and 9*c*, the container 50 may include two removable handle plugs 200 which are placed within the cavity created by the integral handle 84 to allow the container to be placed within a conventional mechanical paint shaker apparatus. The plugs 200 serve as weights, and are effective to shift the center of gravity to the center of the container 50, which makes up for the mass of paint missing due to the cavity created by the integral handle 84. The handle plugs 200 are manufactured from any dense material, for example aluminum, weighted wood or polymer materials. The handle plugs 200 are shaped with an exterior surface which becomes flush with the exterior surface of the container when the plugs 200 are in place. The plugs 200 are maintained in place during the mixing process by a rectangular shaped sleeve or frame 210, (shown in FIG. 21) which secures the container 50 and plugs 200. Alternatively, a single plug 200 may be used, which is slid within the cavity. The plugs 200 function to provide weight balance to the paint can while it is in the shaker apparatus. The integral handle 84 helps create a vortex effect within the container 50 during shaking which provides superior mixing. In comparison, a blend of paint in a conventional paint can which takes 2.5 to 3 minutes to mix thoroughly in a shaker apparatus may be mixed in approximately half of that time within the container of the present application in the same shaker apparatus.

A conventional paint mixing machine or shaker apparatus which holds circular cans only, may be retrofitted to hold both the rectangular version of the container of the present application as well as conventional cans. The square sleeve insert 210 or frame shown in FIG. 21 can be easily installed on the conventional machine. Because the distance from sidewall to sidewall on the rectangular container 50, or the effective footprint, of the present container is equivalent to the diameter of a conventional can, both types can be placed within the retrofit sleeve 210. Weights 212 attached to the retrofit sleeve 210 may be used to replace the handle plugs 200 when mixing paint within a container 50 of the present application. Appropriately sized weights 212 may be attached to the sides of the retrofit sleeve adjacent the corner abutting the integral handle 84 of the container 50. The weights 212 may be welded to the sleeve, bolted or clamped in place, or placed within a holding sleeve. The weights 212 are sized to make up for the mass of paint missing due to the cavity created by the integral handle 84.

Figure 22A:
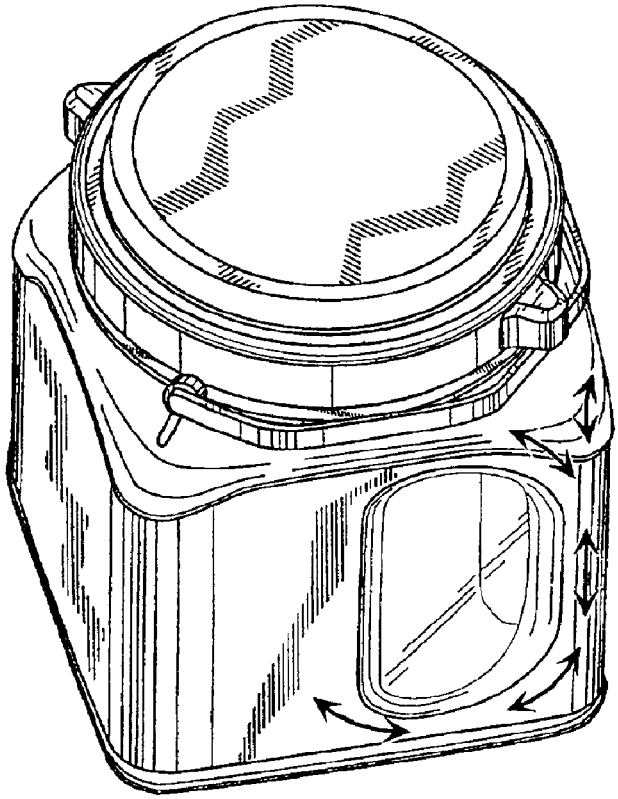
FIG. 22*a* shows the theoretical path of moving fluid in the container integral handle as the fluid within the container is mixed.
Figure 22B:
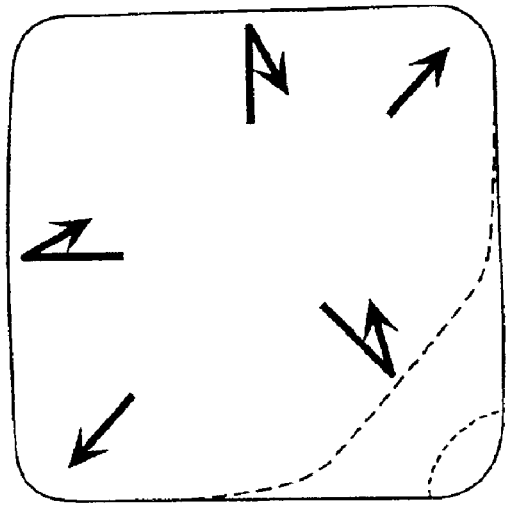
FIG. 22*b* shows the theoretical path of moving fluid within the container during mixing.

Overall, FIG. 22 shows the improved mixing characteristics, illustrated by the varied stream lines, created by the following components of the container of the present application: integral handle (solid or hollow), flat side walls (in rectangular embodiment), sidewall ribs (in cylindrical or rectangular embodiments).

Figure 11:
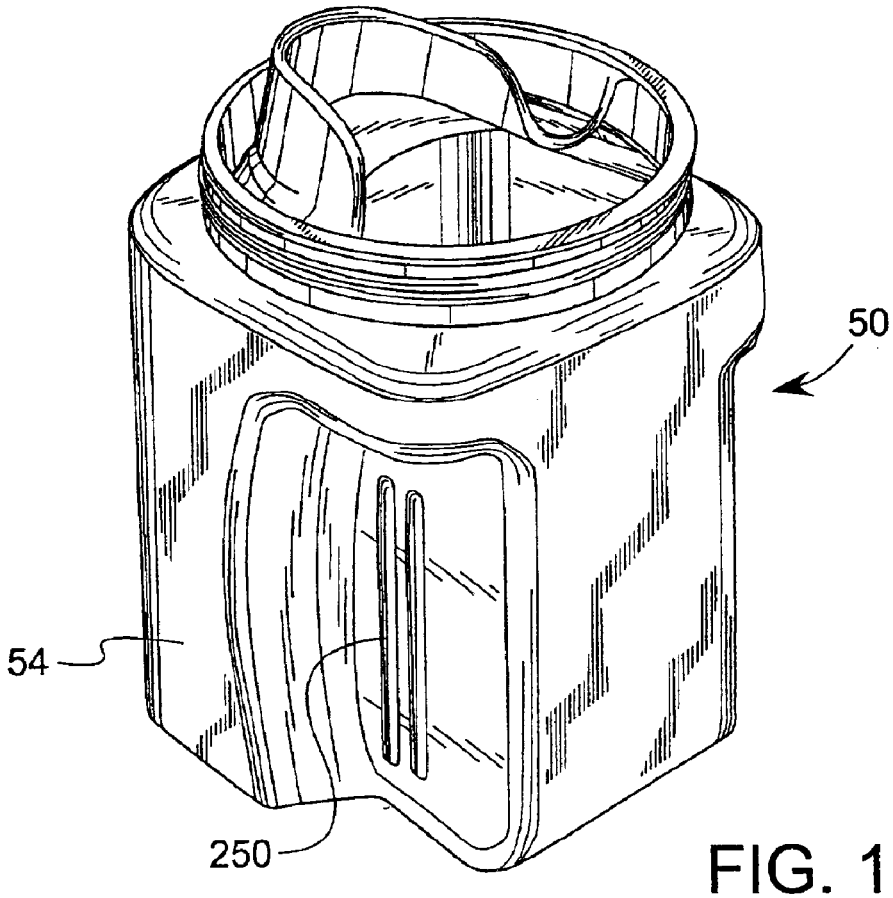
FIG. 11 shows an alternate embodiment of an integral handle of a container of the present application.

Referring to FIG. 11 another variation of handles 250 used to hold the container 50 of the present application is shown which includes handle indentations 250 on adjacent sidewalls 54 of the container. The handle indentations 250 do not join with each other to form a cavity, which exists in other handle embodiments previously described. The handle indentations 250 may include ridges or other types of texturing to increase gripping properties. As shown, the handle indentations 250 may have a rectangular shape with height exceeding width.

Referring to FIG. 12, the orientation of the integral handle 84 to the wide mouth opening is shown. At this diameter, the wide mouth opening is at least 80% as large as the distance between opposite side walls of the container, and is preferably at least 83% as large. The interior wall 82 defining the cavity portion of the integral handle 84 is vertically aligned within, and thus extends into, the wide mouth opening.

Insert Lock

Referring to FIG. 13, a detailed cutaway view of a pinching lock mechanism is shown between the neck 66 of the container and the insert 150. The insert 150 includes a cantilever section 178 with a hooked end 180. The insert 150 also includes a beveled section 182 adjacent to the cantilever section 178. The cantilever section 178, in combination with the beveled section 182 of the insert 150 functions to lock the insert 150 into place over and around the neck of the container. In operation, the insert 150 which is initially detached from the neck 66 may be placed within the opening defined by the neck 66. A portion of a tapered surface 184 of the insert 150 makes contact with a portion of the top of the neck 66. As the insert 150 is forced downward, the tapered surface 184 of the insert 150 slides along a portion of the top of the neck 60 until the beveled section 182 of the insert 150 is reached. Simultaneously, the beveled section 182 of the insert 150 finds the interior beveled section 79 of the neck 66 and the cantilever section 178 of the insert 150 with its hooked end 180 closes over the top of the neck 68. The insert 150 is then locked in place until it is forcefully removed.

The lid 100 contributes to formation of a seal which prevents spillage or drying out of the paint or other coating material within the container 50. To assist in forming a seal, the lid 100 may include an inner ring and lateral sealing surface. The inner ring 116 extends downwardly from the interior side of the lids 100 upper section 106. The lateral sealing surface may be located above the threaded section of the lid. As the lid 100 is screwed onto the neck 66, the inner ring 116 and lateral sealing surface together squeeze the insert 150. The lateral sealing surface 118 abuts the hooked end 180 of the cantilever section 178 and the inner ring 116 abuts the top of the insert 150.

Stacking/Assembly Methods

Figure 14:
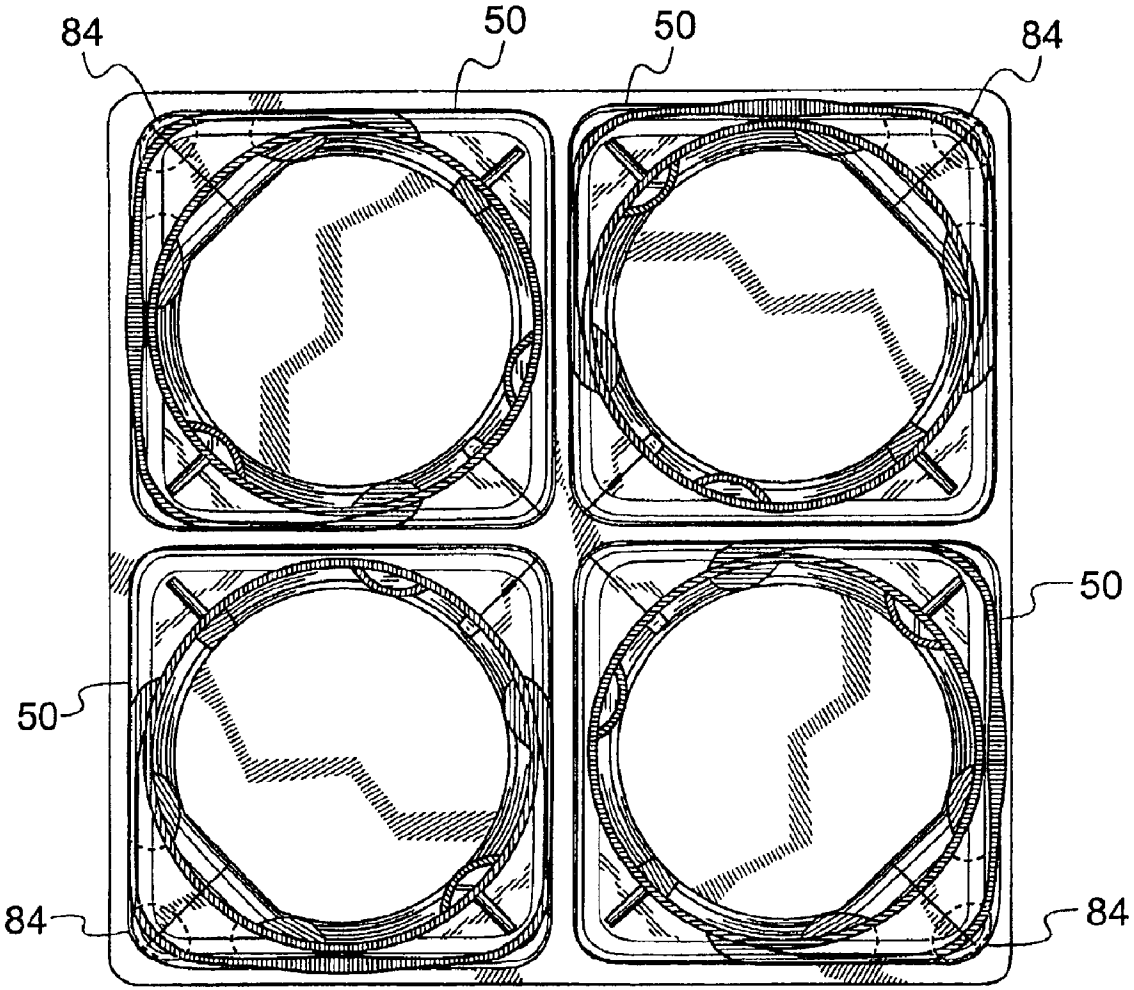
FIG. 14 shows a method of arranging multiple containers.

Referring to FIG. 14, a method for stacking the containers 50 of the present application is shown. The method includes placing four or more containers 50 upon a support such as a pallet or within a box. The containers are placed such that their integral handles 84 are oriented towards the exterior of the support. This orientation provides strength against impacts against the side of the group of containers and strength on the exterior which aides in stacking. A second support and a second set of at least four containers 50 may then be placed within a box upon the top of the first set of boxed containers in the same orientation. In practice, three additional levels of four boxed containers may be added to a single pallet. In practice, a second pallet of up to five levels of containers may be placed on top of the first pallet. The container handle orientation allows the individual containers to be easily removed from a stack formed from multiple pallets and sets.

Figure 17:
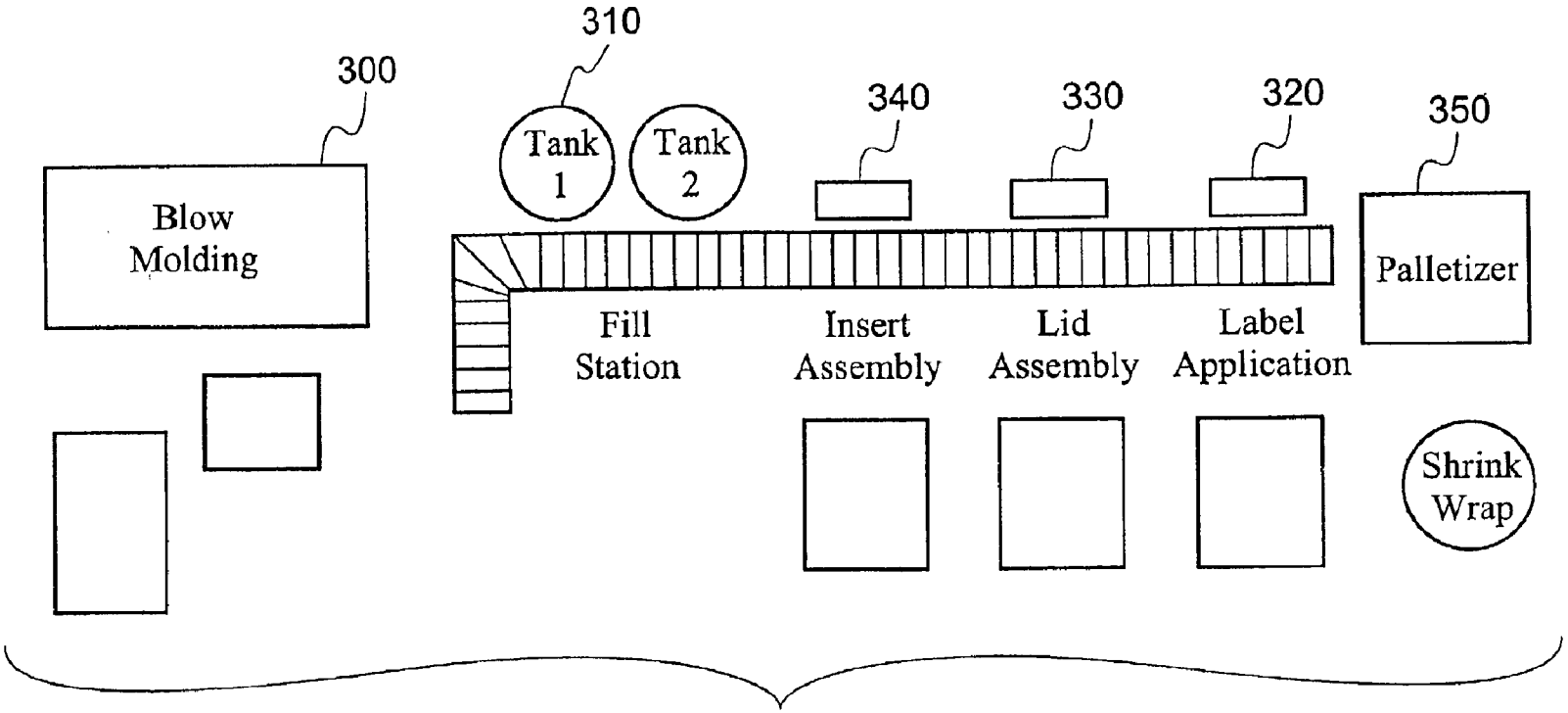
FIG. 17 shows a schematic diagram of a manufacturing system for manufacturing, filling and additionally preparing the container of the present application for shipment or storage.

Referring to FIG. 17, the container of the present application may be fabricated and assembled in a compact area of a manufacturing facility or in side by side manufacturing facilities. In a preferred method, a fabrication machine, typically a blow molding machine 300, is located in close proximity to paint mixing and filling machines 310. A benefit to this layout is that large container parts do not need to be stored or shipped from facility to facility. In one method of manufacture, a molding facility is located directly next to a paint formulating facility and molded container parts are transferred through a passage in a wall from the former to the latter. Final preparation machines such as label applicators 320, lid assembly 330 and application machines, assemblers 340 and palletizers 350 may also be located within close proximity. The application and assembly operations may be performed in any order.

Variations

Figure 15:
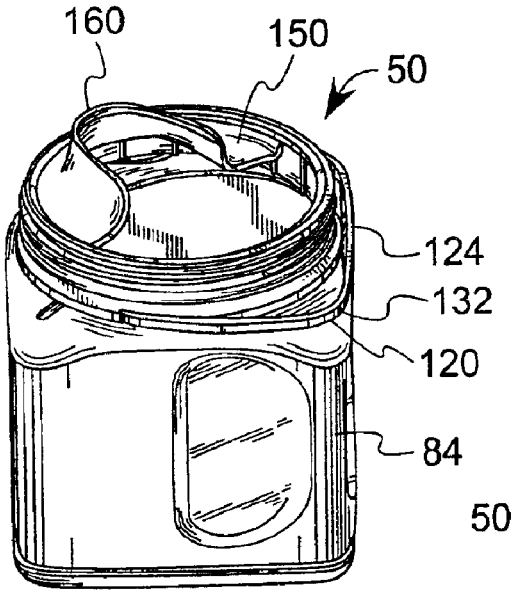
FIG. 15 shows a preferred orientation of an insert with respect to the rest of a container.

FIG. 15 shows a container assembled having a preferred alignment of the insert 150. The spout 160 of the insert 150 is oriented opposite the integral handle 84. The bail handle 120 is oriented such that when the arcuate member 124 is lowered, the central subsection 132 may rest directly above the integral handle 84. As shown in FIGS. 6 and 25*d*, the lugs 108 upon the lid 100 are oriented such that a lug 108 is directly above the container corner including the integral handle 84 when the lid is sealed on the container. Thus, all aspects of the illustrated embodiment are properly aligned for ease of shipping and use of the container and lid assembly by consumers.

Figure 16A:
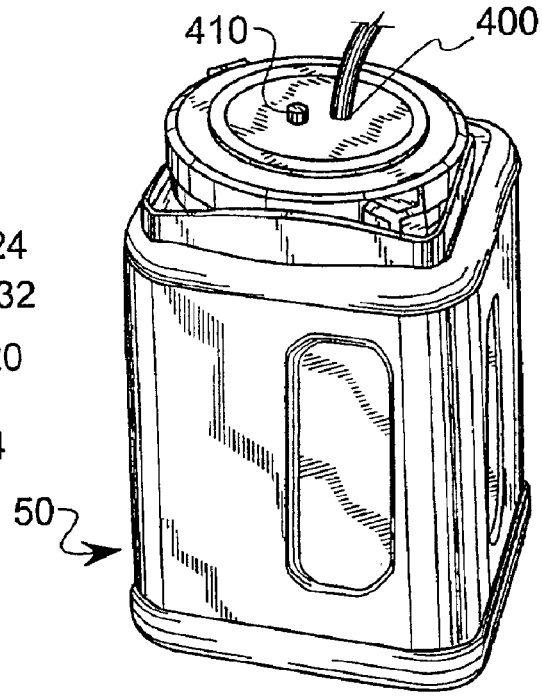
FIG. 16*a* shows a container with a vented lid.
Figure 16B:
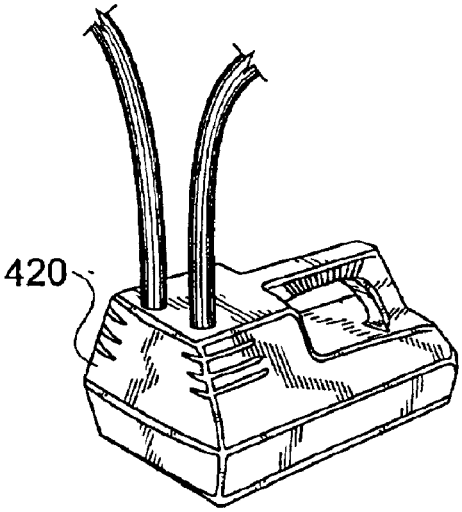
FIGS. 16*b* and 16*c* show accessories used with the container of the present application.
Figure 16C:
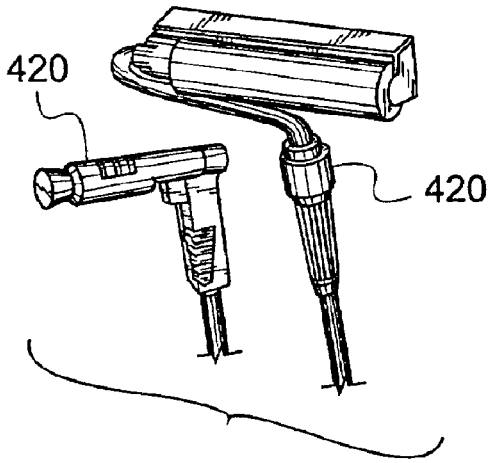

Referring to FIGS. 16A, 16B and 16C an embodiment of the application is shown with the container lid 100 including a hole 400 and vent 410 combination. The hole 400 may be normally plugged and opened when the liquid within the container 56 is to be used with an accessory or auxiliary device 420, for example, as a paint sprayer. The vent 410 also may be normally closed, but opened when the hole 400 is unplugged. The vent 410 allows air to enter the container 50 to replace liquid withdrawn, for example, under a vacuum, by an accessory 420 during painting or other operations.

Attached hereto as Attachment 1 and Attachment 2 are the original provisional applications as described above.

Additional advantages and modifications will readily appear to those skilled in the art. For example, the container may include additional reinforcement ribs. Further, other handle cross sectional shapes may be provided for handling comfort. Also, instructions, numbering and symbols may be added to or molded into parts of the container. Therefore, the application in its broader aspects, is not limited to the specific details, the representative apparatus, and illustrative examples shown and described. Accordingly, departures may be made from such details without departing from the spirit or scope of the applicant's general concept.

What is claimed is:

1. A plastic container and lid assembly for storing liquid coating materials, the assembly comprising:

a container and a lid;

said container having a body with a bottom wall, at least one sidewall and a neck;

said neck defining a wide mouth opening and including threads for receiving mating threads on said lid;

said lid also having a plurality of lugs extending radially therefrom and terminating at or before said lugs extend beyond said container sidewall when said lid is in sealed engagement with said container;

said body also having an integral handle for lifting said container, and said container neck supporting a bail-type handle also for lifting said container, and said integral handle and bail-type handle do not extend beyond said container sidewall;

said container and lid assembly having an effective packing footprint which substantially conforms to the effective packing footprint of a conventional metal paint can.

2. A plastic container and lid assembly for storing liquid coating materials, the assembly comprising:

a container and a lid;

said container having a body with a bottom wall, at least four sidewalls and a neck;

said neck defining a wide mouth opening and including threads for receiving mating threads on said lid;

said lid also having a plurality of lugs extending radially therefrom and terminating at or before said lugs extend beyond said container sidewall when said lid is in sealed engagement with said container;

said body also having an integral handle for lifting said container, and said container neck supporting a bail-type handle also for lifting said container, and said integral handle and bail-type handle do not extend beyond said container sidewall;

said container and lid assembly having an effective packing footprint which substantially conforms to the effective packing footprint of a conventional metal paint can.

3. The assembly of claim 1 wherein said body includes four sidewalls.

4. The assembly of claim 1 or 2 wherein said body is blow-molded.

5. The assembly of claim 4 wherein at least a portion of said container body is partially comprised of transparent plastic material.

6. The assembly of claim 4 wherein said container fits within a cavity of a conventional mechanical paint shaker apparatus.

7. The assembly of claim 4 wherein said bottom wall of said container includes an indentation capable of aligning with a top section of a lid of a second plastic container and lid assembly.

8. The assembly of claim 1 or 2 wherein said bail-type handle is injection molded.

9. The assembly of claim 1 wherein said container further includes a round bottom wall and said body includes a single sidewall.

10. The assembly of claim 1 or 2 wherein said wide mouth opening has a diameter which is at least eighty percent of the diameter of the container.

11. The assembly of claim 10 wherein said container further comprises an insert mounted within the wide mouth opening of said container, said insert comprising an outer wall and a web attached to an inside of said outer wall wherein said web defines a spout and a flow back channel between said spout and said outer wall.

12. The assembly of claim 6 or 2 further comprising an insert mounted within the wide mouth opening of said container, said insert having an opening sized for insertion of a 10 cm or 4 inch paintbrush and a flat backwall for wiping liquid coating materials off of a paintbrush.

13. The assembly of claim 12 wherein said insert is mounted flush with respect to said wide mouth opening.

14. The assembly of claim 13 wherein said insert further includes a slit for assisting removal of paint from a tool.

15. The assembly of claim 6 or 2 further comprising an insert mounted within the wide mouth opening of said container, said insert having a spout portion for pouring liquid coating material from said container, and a notch for engagement with said container to ensure alignment of said insert with respect to said container.

16. The assembly of claim 15 wherein said body includes a tab projecting into the container for engagement with said notch of said insert to align said insert in a pouring position.

17. The assembly of claim 15 wherein said spout portion extends radially upward from the wide mouth opening by a distance less than the radius of said insert.

18. The assembly of claim 17 wherein said insert further comprises a flowback channel outside of, beneath and substantially surrounding said spout portion.

19. The assembly of claim 18 wherein said flowback channel is angled downwardly away from the spout portion toward the container.

20. The assembly of claim 2 wherein said container further includes a substantially square shaped bottom wall and a substantially square shaped body in cross sectional configuration.

21. The assembly of claim 2 wherein said neck further comprises a bail seat and a lip above said bail seat.

22. The assembly of claim 21 wherein said bail-type handle comprises a hoop circumscribing said neck and a movable arcuate member affixed to said hoop.

23. The assembly of claim 22 wherein said arcuate member is attached to said hoop with a socket and disk movable joint.

24. The assembly of claim 23 wherein said hoop is keyed to said neck of the container for ensuring proper alignment of said bail-type handle with respect to said container.

25. The assembly of claim 23 wherein said hoop is free to rotate about said neck of the container.

26. The assembly of claim 23 wherein said arcuate member toggles over an edge of said neck.

27. The assembly of claim 22 wherein said arcuate member has a continuous variable cross section.

28. The assembly of claim 22 wherein said arcuate member comprises curved and straight sub-sections.

29. The assembly of claim 28 wherein said arcuate member includes a central sub-section which is straight.

30. The assembly of claim 22 wherein said arcuate member includes a central sub-section which is curved.

31. The assembly of claim 2 wherein said neck includes an imaginary fill line which is less than one inch from the top of said wide mouth opening, and when in a filled condition, fluid within said assembly reaches said imaginary fill line.

32. The assembly of claim 2 wherein said lid includes an internal double helix thread for mating with the threads on the container neck.

33. The assembly of claim 32 wherein said double helix thread on said lid engages said neck threads such that sealing engagement of said double helix thread is provided on said neck threads upon between one half and three quarters of one revolution.

34. The assembly of claim 2 wherein said integral handle is hollow.

35. The assembly of claim 34 wherein said plurality of lugs comprises four lugs.

36. The assembly of claim 34 wherein said plurality of lugs comprises two lugs.

37. The assembly of claim 2 wherein said plurality of lugs comprises four lugs.

38. The assembly of claim 37 wherein said four sidewalls are joined and define four corners, and said lugs are aligned over said corners when said lid is in sealed engagement with said container.

39. The assembly of claim 38 wherein said integral handle is formed at one of said four corners.

40. The assembly of claim 38 wherein said corners are rounded.

41. The assembly of claim 40 wherein said sidewalls are recessed from said corners and bottom wall and provide a surface for supporting a label thereon.

42. The assembly of claim 41 wherein a corner opposite said corner including said integral handle is contoured with a lower profile to facilitate pouring of said liquid material from said container.

43. The assembly of claim 40 wherein said corners are rounded to a radius of approximately 0.75 inches.

44. The assembly of claim 2 wherein said plurality of lugs comprises two lugs.

45. The assembly of claim 2 wherein said lid comprises a hole and vent combination.

46. The assembly of claim 45 further comprising an auxiliary device coupled to said hole, said auxiliary device capable of applying a vacuum to the container such that coating material from the container is supplied directly to the auxiliary device.

47. The assembly of claim 46 wherein the auxiliary device is a paint sprayer.

48. A plastic container for storing paint, the paint container comprising:

a body having a bottom wall, at least one sidewall and a neck;

said neck defining a wide mouth opening and including threads for receiving mating threads of a screw on a lid;

said body further comprising a first handle for lifting said container;

said body further comprising a tab for positioning an insert;

an insert mounted within the wide mouth opening of said neck and wherein said insert further comprises a notch for interlocking with said tab to align said insert in a pouring position; and a second handle comprising a hoop circumscribing said neck and a movable arcuate member affixed to said hoop.

49. The plastic container of claim 48 wherein said insert includes a spout and when said insert is in a pouring position, said spout is oriented on the opposite side of the container from said first handle.

* * * * *

UNITED STATES PATENT AND TRADEMARK OFFICE

CERTIFICATE OF CORRECTION

PATENT NO. : 6,983,862 B2
APPLICATION NO. : 10/126481
DATED : January 10, 2006
INVENTOR(S) : John R. Nottingham et al.

It is certified that error appears in the above-identified patent and that said Letters Patent is hereby corrected as shown below:

In the Specification

Column 4, Line 27, delete “embodiment”, insert --embodiment,--.

In the Claims

Column 14, Line 41 and Line 50, delete “claim 6 or 2”, insert --claim 1 or 2--.

Signed and Sealed this
Sixteenth Day of June, 2015

Michelle K. Lee

Michelle K. Lee
*Director of the United States Patent and Trademark Office*